United States Patent [19]

Kondo et al.

[11] Patent Number: 5,035,969

[45] Date of Patent: Jul. 30, 1991

[54] ELECTROPHOTOGRAPHIC PHOTORECEPTOR CONTAINING PHTHALOCYANINE

[75] Inventors: Syunichi Kondo; Hiroaki Yokoya; Seiji Horie, all of Kanagawa, Japan

[73] Assignee: Fuji Photo Film Co., Ltd., Kanagawa, Japan

[21] Appl. No.: 476,909

[22] Filed: Feb. 8, 1990

[30] Foreign Application Priority Data

Feb. 9, 1989 [JP] Japan ..... 1-30407
Mar. 3, 1989 [JP] Japan ..... 1-51566
Mar. 3, 1989 [JP] Japan ..... 1-51567

[51] Int. Cl.[5] ..... G03G 5/06; G03G 5/09

[52] U.S. Cl. ..... 430/83; 430/95; 430/78

[58] Field of Search ..... 430/95, 83, 78

[56] References Cited

U.S. PATENT DOCUMENTS 4,419,429 12/1983 Nakazawa ..... 430/83

*Primary Examiner*—David Welsh
*Attorney, Agent, or Firm*—Sughrue, Mion, Zinn, Macpeak & Seas

[57] ABSTRACT

A novel electrophotographic photoreceptor for copying machine or photoprinter is provided comprising on an electrically conductive support a photoconductive layer, characterized in that said photoconductive layer contains a phthalocyanine pigment and a compound represented by the general formula (I), (II), (III), (IV) or (VI):

(I)

wherein Z represents a sulfur or oxygen atom; Ar represents a monovalent aromatic hydrocarbon group or monovalent heterocyclic group; $R_3$ represents a hydrogen atom, alkyl group, aryl group or aralkyl group; Ar and $R_3$ may together form a ring; and $R_1$ and $R_2$ may be the same or different and each represents an alkyl group, aryl group or aralkyl group, (II)

(III)

(IV)

wherein Z represents a sulfur or oxygen atom; $R_4$ represents an alkyl group, alkoxy group, monovalent or bicyclic condensed aryl group, monocyclic or bicyclic condensed aryloxy group or monovalent group derived from heterocyclic group; the two $R_4$'s in the general formula (IV) being the same or different; $R^5$ and $R^6$ may be the same or different and each represents a hydrogen atom, alkyl group, monocyclic or bicyclic condensed aryl group or monovalent group derived from heterocyclic group; $R^7$ represents a methylene group, polymethylene group, branched alkanediyl group or arylene group; and $R^4$ and $R^5$ or $R^5$ and $R^6$ may be connected to each other, (V)

(VI)

wherein Z represents a sulfur or oxygen atom; $R^8$, $R^9$, $R^{10}$, $R^{11}$, $R^{12}$ and $R^{13}$ may be the same or different and each represents a hydrogen atom, an alkyl group, aryl group or monovalent group derived from heterocyclic group, $R^8$ and $R^9$ or $R^{10}$ and $R^{11}$ being optionally connected to each other; $R^8$, $R^9$, $R^{10}$ and $R^{11}$ in the general formula (V) being optionally connected to each other to form a crosslinked ring; and $R^{14}$ represents a divalent arylene group, aralkylene group, polymethylene group or alkylene group.

6 Claims, No Drawings

ELECTROPHOTOGRAPHIC PHOTORECEPTOR CONTAINING PHTHALOCYANINE

FIELD OF THE INVENTION

The present invention relates to an electrophotographic photoreceptor comprising a photoconductive layer provided on an electrically conductive support

BACKGROUND OF THE INVENTION

Electrophotographic photoreceptors which exhibit a light sensitivity in visible light range have been provided for the purpose of application to copying machine, photoprinter and the like. As such electrophotographic photoreceptors there have been widely used photoreceptors essentially comprising an inorganic photoconductive substance such as sellenium, zinc oxide and cadmium sulfide. However, these inorganic photoreceptors cannot always satisfy the properties required for electrophotographic photoreceptors for copying machine or the like, such as light sensitivity, thermal stability, humidity resistance and durability.

For example, selenium photoreceptors are subject to crystallization by heat or stain of fingerprint given when touched with hand and thus are susceptible to electrophotographic photoreceptors for this application.

Electrophotographic photoreceptors comprising cadmium sulfide are poor in humidity resistance and durability. Electrophotographic photoreceptors comprising zinc oxide leave to be desired in film strength or other durability. Furthermore, selenium and cadmium sulfide are toxic and thus give a great restriction in preparation and handling.

In recent years, electrophotographic photoreceptors comprising various organic substances have been studied, developed and partily put into practical use to overcome these disadvantages of photoreceptors comprising inorganic substances. Examples of such electrophotographic photoreceptors include electrophotographic photoreceptors comprising poly-N-vinylcarbazole and 2,4,7-trinitrofluorene-9-one as described in U.S. Pat. No. 3,484,237, poly-N-vinylcarbazole sensitized with a pyririum salt dye as described in JP-B-48-25658 (the term "JP-B" as used herein means an "examined Japanese patent publication"), electrophotographic photoreceptors comprising as a main component an organic pigment as described in JP-A-47-37543 (the term "JP-A" as used herein means an "unexamined published Japanese patent application"), and electrophotographic photoreceptors comprising as a main component an eutectic complex of a dye and a resin as described in JP-A-47-10785.

However, although these photoreceptors can overcome the above mentioned disadvantages to some extent, they are generally disadvantageous in that they exhibit a low light sensitivity and are not suited for repeated use. Thus, these photoreceptors cannot sufficiently satisfy the above mentioned properties.

In order to overcome these disadvantages, an electrophotographic photoreceptor has been proposed comprising a photoconductive layer having a charge-generating effect and a charge-transporting effect accomplished by separate substances. Such a separate effect type electrophotographic photoreceptor has become a major target of the current study. In the study of such a separate effect type electrophotographic photoreceptor, the range of materials to be selected has been widened. This has enabled the improvement in sensitivity, durability and other properties of the electrophotographic photoreceptors. Furthermore, the separate effect type electrophotographic photoreceptor is advantageous in that substances suitable for coating of film of electrophotographic photoreceptor can be selected from a wide range of substances.

As effective organic charge-generating substances to be incorporated in the charge-generating layer in such a separate effect type electrophotographic photoreceptor there have been developed various organic dyes and organic pigments. Examples of such organic dyes and pigments include azo pigments, perylene pigments, polycyclic quinone pigments and squaric methine dyes having various structures.

However, although these pigments exhibit a relatively excellent sensitivity in a short or middle wavelength range, they exhibit a poor sensitivity in a long wavelength range and thus can hardly be used in laser printers employing a semiconductor laser which is expected to provide a high reliability. At present, the vibration wavelength of a potassium-aluminum-arsenic light-emitting element which is widely used for semiconductor laser is 750 nm or higher.

A phthalocyanine compound, which is one of organic photoconductive materials, is known to have an extended sensitivity range in a long wavelength range as compared to the above mentioned pigments and dyes. However, such a phthalocyanine compound leaves to be desired in electrophotographic properties such as sensitivity and chargeability. In order to overcome these defects, various improvements have been made. For example, various central metals have been used for phthalocyanine. Furthermore, various crystal forms have been developed. Various crystal forms of phthalocyanines have been found in the process during which an unstable $\alpha$-type phthalocyanine is converted to a stable $\beta$-type phthalocyanine. For example, $\epsilon$-type copper-containing phthalocyanine, X-type metal-free phthalocyanine, and m-type titanyl phthalocyanine have been known. Although these phthalocyanines exhibit sensitivity in a long wavelength range, their sensitivity is not sufficient for copying machine or photoprinter. They are also disadvantageous in that they lack potential stability or show a large residual potential after repeated use. Thus, these phthalocyanines cannot be put into practical use.

On the other hand, in order to improve the sensitivity of an electrophotographic photoreceptor comprising a phthalocyanine pigment, it has been proposed to incorporate a charge-transporting compound such as hydrazone compound and oxazole compound or an electron attractive compound such as tetranitrofluorene and trinitrofluorene therein. This approach can provide a sensitizing effect but cannot provide a sufficient sensitizing effect. Furthermore, an electrophotographic photoreceptor comprising such an additive exhibits a drop in chargeability or shows a drop in potential stability and sensitivity and a rise in residual potential after repeated use and thus cannot be put into practical use. Moreover, such an electron attractive compound is toxic and thus cannot be put into practical use.

It has therefore been desired to provide an electrophotographic photoreceptor which is highly sensitive to light of a wavelength of 750 nm or more and exhibits a high potential stability, small residual potential and small drop in sensitivity.

SUMMARY OF THE INVENTION

It is therefore an object of the present invention to provide an electrophotographic photoreceptor which is highly sensitive, especially to light of a long wavelength such as semiconductor laser and exhibits a high potential stability, a small residual potential and high durability after repeated use.

The above and other objects of the present invention will become apparent from the following detailed description and examples.

As a result of extensive studies, the inventors found that a compound represented by the general formula (I), (II), (III), (IV), (V) or (VI) can sensitize a phthalocyanine pigment. The inventors further found that a photoreceptor comprising a phthalocyanine pigment and a compound represented by the general formula (I), (II), (III), (IV), (V) or (VI) can exhibit a higher potential stability and a lower charge retention than photoreceptors comprising other pigments.

These objects of the present invention are accomplished with a electrophotographic photoreceptor for copying or photoprinter is provided comprising on an electrically conductive support a photoconductive layer, characterized in that said photoconductive layer contains a phthalocyanine pigment and, a compound represented by the general formula (I), (II), (III), (IV) or (VI):

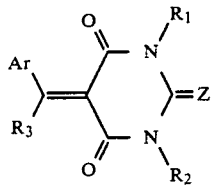

(I)

wherein Z represents a sulfur or oxygen atom; Ar represents a monovalent aromatic hydrocarbon group or monovalent heterocyclic group; $R^3$ represents a hydrogen atom, alkyl group, aryl group or aralkyl group; Ar and $R^3$ may together form a ring; and $R^1$ and $R^2$ may be the same or different and each represents an alkyl group, aryl group or aralkyl group,

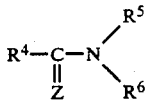

(II)

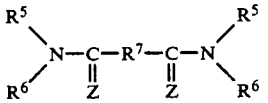

(III)

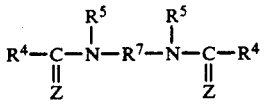

(IV)

wherein Z represents a sulfur or oxygen atom; $R^4$ represents an alkyl group, alkoxy group, monovalent or bicyclic condensed aryl group, monocyclic or bicyclic condensed aryloxy group or monovalent group derived from heterocyclic group; the two $R^4$'s in the general formula (IV) being the same or different; $R^5$ and $R^6$ may be the same or different and each represents a hydrogen atom, alkyl group, monocyclic or bicyclic condensed aryl group or monovalent group derived from heterocyclic group; $R^7$ represents a methylene group, polymethylene group, branched alkanediyl group or arylene group; and $R^4$ and $R^5$ or $R^5$ and $R^6$ may be connected to each other,

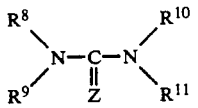

(V)

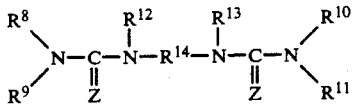

(VI)

wherein Z represents a sulfur or oxygen atom; $R^8$, $R^9$, $R^{10}$, $R^{11}$, $R^{12}$ and $R^{13}$ may be the same or different and each represents a hydrogen atom, an alkyl group, aryl group or monovalent group derived from heterocyclic group, $R^8$ and $R^9$ or $R^{10}$ and $R^{11}$ being optionally connected to each other; $R^8$, $R^9$, $R^{10}$ and $R^{11}$ in the general formula (V) being optionally connected to each other to form a crosslinked ring; and R14 represents a divalent arylene group, aralkylene group, polymethylene group or alkylene group.

In a preferred embodiment, the photoconductive layer is a single layer containing a phthalocyanine pigment and at least one of compounds represented by the general formula (I), (II), (III), (IV), (V) and (VI). Alternatively, the photoconductive layer consists of a charge-generating layer containing a phthalocyanine pigment and at least one of compounds represented by the general formula (I), (II), (III), (IV), (V) and (VI) and a charge-transporting layer. The light source of said copying machine or photoprinter may be a laser.

DETAILED DESCRIPTION OF THE INVENTION

Examples of phthalocyanine pigments to be incorporated in the photoconductive layer in the present electrophotographic photoreceptor contain those containing different central metals, those having different crystal forms and those having substituents in benzene ring. Specific examples of these phthalocyanine pigments include metal-free phthalocyanines as described in JP-B-44-14106, JP-B-45-8102, JP-B-46-42511, JP-B-46-42512 and JP-B-49-4338, and JP-A-58-182639 and JP-A-62-47054, copper phthalocyanines as described in JP-A-50-38543, JP-A-50-95852, JP-A-51-108847 and JP-A-51-109841, titanyl phthalocyanines as described in JP-A-59-49544, JP-A-59-166959, JP-A-62-275272, JP-A-62-286059, JP-A-62-67094, JP-A-63-364, JP-A-63-365, JP-A-63-37163, JP-A-63-57670, JP-A-63-80263, JP-A-63-116158 and JP-A-63-198067, aluminum phthalocyanines as described in JP-A-57-90058, JP-A-62-163060, JP-A-62-133462, JP-A-62-177069, JP-A-63-73529 and JP-A-63-43155, vanadyl phthalocyanines as described in JP-A-57-146255, JP-A-57-147641 and JP-A-57-148747, and halogenized metal phthalocyanines as described in JP-A-59-44053, JP-A-59-128544, JP-A-59-133550, JP-A-59-133551, JP-A-59-174846, JP-A-59-174847, JP-A-60-59354, JP-A-60-260054, JP-A-60-220958, JP-A-62-229254, JP-A-63-17457, JP-A-59-155851, JP-A-63-27562 and JP-A-63-56564. However, the present invention should not be construed as being limited thereto. Other known various phthalocyanines can be used in the present invention.

As typical examples of central metals there have been known copper, nickel, iron, vanadium, aluminum, gallium, indium, silicon, titanium, magnesium, cobalt, platinum, germanium, etc. Phthalocyanine dyes free of central metals have also been known.

As crystal forms of phthalocyanine pigments there have been known various crystal forms observed by X-ray crystalodiffraction on metal-containing phthalocyanines and metal-free phthalocyanines. For copper-containing phthalocyanines, polymorphism such as $\alpha$ type, $\beta$ type, $\gamma$ type, $\sigma$ type, $\epsilon$ type, $\eta$ type, and $\rho$ type have been known. For metal-free phthalocyanines, polymorphism such as $\alpha$ type, $\beta$ type, x type and $\tau$ type have been known. For titanylphthalocyanines, polymorphism such as $\alpha$ type, $\beta$ type and m type have been known. In addition, substituted phthalocyanines having benzene rings substituted by halogen atoms such as fluorine, chlorine and bromine, alkyl group, carboxyl group, amido group, sulfonyl group or other substituents have been known.

Other examples of phthalocyanines which can be used in the present invention include geramnium-containing naphthalocyanines as described in JP-A-63-233886, JP-A-63-186251, and JP-A-63-72761, silicon-containing naphthalocyanines as described in JP-A-63-55556, and JP-A-63-141070, tin-containing naphthalocyanines as described in JP-A-63-186251 and JP-A-6 4- 2061, and various metal-containing naphthalocyanines as described in JP-A-63-72761 and JP-A-63-231355.

These phthalocyanines have different absorption wavelength ranges and are properly used depending on the purpose of application. In the case where the photoreceptor is used in a laser beam printer employing a semiconductor laser as a light source, a phthalocyaine dye having absorption in the wavelenth of 780 to 830 nm may be preferably used.

The present compound represented by the general formula (I) capable of improving the photoconductivity of the photoconductive layer comprising such a phthalocyanine will be further described hereafter.

$R^1$ and $R^2$ represent an alkyl group which may contain a substituent, aryl group which may contain a substituent or aralkyl group which may contain a substituent. Examples of substituents include alkyl group, cyano group, hydroxyl group, carboxyl group, nitro group, halogen atom (e.g., chlorine, fluorine, bromine), amino group, alkoxy group, aryl group, aryloxy group, alkoxycarbonyl group, acyloxy group, amino group substituted by alkyl group, aryl group or aralkyl group, and trifluoromethyl group. Specific examples of $R^1$ and $R^2$ include straight-chain, branched or substituted alkyl group such as methyl group, ethyl group, n-propyl group, iso-propyl group, n-butyl group, sec-butyl, n-hexyl group, 2-ethylhexyl group, fluoromethyl group, chloromethyl group, trifluoromethyl group, perfluoroalkyl group, methoxymethyl group and cyanomethyl group, and aryl group, substituted aryl group, aralkyl group or substituted aralkyl group such as phenyl group, p-trifluoromethylphenyl group, o-trifluoromethylphenyl group, p-cyanophenyl group, o-cyanophenyl group, p-nitrophenyl group, o-nitrophenyl group, p-bromophenyl group, o-bromophenyl group, p-chlorophenyl group, o-chlorophenyl group, p-fluorophenyl group, o-fluorophenyl group, N,N-dimethylamido group, N,N-diethylamido group, p-carboxylphenyl group, p-methoxyphenyl group, o-methoxyphenyl group, N,N-diethylaminophenyl group, N,N-diphenylaminophenyl group, N,N-dibenzylaminophenyl group, N,N-dimethylphenyl group, naphthyl group, methoxynaphthyl group, N,N-diethylaminonaphthyl group, benzyl group, p-bromobenzyl group, p-cyanobenzyl group, p-nitrobenzyl group, p-trifluoromethylbenzyl group, o-bromobenzyl group, o-cyanobenzyl group, o-nitrobenzyl group, phenylethyl group, 3-phenylpropyl group, p-chlorobenzyl group and naphthylmethyl group. $R^1$ and $R^2$ may be the same or different.

In $R^1$ and $R^2$, the carbon number of the alkyl group is 1 to 20, preferably 1 to 12, that of the aryl group is 6 to 20, preferably 6 to 12, and that of the aralkyl group is 7 to 20, preferably 7 to 12.

In these substituents for $R^1$ and $R^2$, the carbon number of the alkyl group is 1 to 20, preferably 1 to 12, that of the alkoxy group is 1 to 20, preferably 1 to 12, that of the aryl group is 6 to 20, preferably 6 to 12, that of the aryloxy group is 6 to 20, preferably 6 to 12, that of the alkoxycarbonyl group is 2 to 20, preferably 7 to 20, and that of the acyloxy group is 1 to 20, preferably 1 to 12. In the substituted amino group, the carbon number of the alky group is 1 to 20, preferably 1 to 12, that of the aryl group is 6 to 20, preferably 6 to 12, and that of the aralky group is 7 to 20, preferably 7 to 12.

$R^3$ represents a hydrogen atom and an alkyl group which may contain a substituent, aryl group which may contain a substituent or aralkyl group which may contain a substituent. Examples of substituents contained in these groups which are substituted include the same substituents as described with reference to $R_1$ and $R_2$ Specific examples of $R^3$ include hydrogen atom, straight-chain, branched or substituted alkyl group such as methyl group, ethyl group, n-propyl group, iso-propyl group, n-butyl group, sec-butyl group, n-hexyl group, 2-ethylhexyl group, fluoromethyl group, chloromethyl group, trifluoromethyl group, perfluoroalkyl group, methoxymethyl group and cyanomethyl group, and aryl group, substituted aryl group, aralkyl group or substituted aralkyl group such as phenyl group, p-trifluoromethylphenyl group, o-trifluoromethylphenyl group, p-cyanophenyl group, o-cyanophenyl group, p-nitrophenyl group, o-nitrophenyl group, p-bromophenyl group, o-bromophenyl group, p-chlorophenyl group, o-chlorophenyl group, p-fluorophenyl group, o-fluorophenyl group, N,N-dimethylamido group, N,N-diethylamido group, p-carboxylphenyl group, p-methoxyphenyl group, o-methoxyphenyl group, N,N-diethylaminophenyl group, N,N-diphenylaminophenyl group, N,N-dibenzylaminophenyl group, N,N-dimethylphenyl group, naphthyl group, methoxynaphthyl group, cyanonaphthyl group, nitronaphthyl group, chloronaphthyl group bromonaphthyl group, fluoronaphthyl group, trifluoromethylnaphthyl group, N,N-diethylaminonaphthyl group, benzyl group, phenylethyl group, 3-phenylpropyl group, p-chlorobenzyl group, p-bromobenzyl group, p-cyanobenzyl group, p-nitrobenzyl group, p-trifluoromethylbenzyl group, o-bromobenzyl group, o-cyanobenzyl group, o-nitrobenzyl group and naphthylmethyl group.

In $R^3$, the carbon number of the alkyl group is 1 to 20, preferably 1 to 12, that of the aralkyl group is 6 to 20, preferably 6 to 12, and that of the aralkyl group is 7 to 20, preferably 7 to 12.

Ar represents a monovalent aromatic hydrocarbon group (having 6 to 20 carbon atoms, preferably 6 to 12 carbon atoms) which may contain a substituent or monovalent heterocyclic group which may contain a substituent. Examples of such an aromatic hydrocarbon group or heterocyclic group include phenyl group, naphthyl group, anthranil group, furan, pyrrole, thiophene, indole, benzofuran, benzothiofuran, thio oxazole, imidazole, thiazole, isoxazole, pyridine, quinoline, isoquinoline, pyridazine, pyrimidine, pyrazine, phthalazine, and derivatives thereof, such as 2-thio-4-thiazolidinone, 3 pyrazolidinone, 5-isoxazolone, 2-oxazolidone, 2,4-thiazolidinedione, 2-thiophenone, 2-furanone and 4-pyrimidone. Examples of substituents which may be contained in these groups include straight-chain, branched or substituted alkyl group such as methyl group, ethyl group, n-propyl group, iso-propyl group, n-butyl group, sec-butyl group, n-hexyl group, 2-ethylhexyl group, fluoromethyl group, chloromethyl group, trifluoromethyl group, perfluoroalkyl group, methoxymethyl group and cyanomethyl group, unsubstiteted or substituted aryl group (having 6 to 10 carbon atoms) or, unsubstituted or substituted aralkyl group (having 7 to 10 carbon atoms) such as phenyl group, p-trifluoromethylphenyl group, o-cyanophenyl group, p-nitrophenyl group, p-bromophenyl group, o-bromophenyl group, o-chlorophenyl group, p-fluorophenyl group, p-methoxyphenyl group, N,N-diethylaminophenyl group, N,N-dimethylaminophenyl group, naphthyl group, methoxynaphthyl group, cyanonaphthyl group, chloronaphthyl group, benzyl group, phenylethyl group, 3-phenylpropyl group, p-chlorobenzyl grup, p-cyanobenzyl grup, p-nitrobenzyl group, p-trifluoromethylbenzyl group o-bromobenzyl group, ocyanobenzyl group, o-nitrobenzyl group and naphthylmethyl group, cyano group, hydroxyl group, carboxyl group, nitro group, halogen atom such as chlorine, fluorine and bromine, group represented by —NHCORa (in which Ra represents a substituted or unsubstituted alkyl group (having 1 to 10 carbon atoms), aryl group (having 6 to 10 carbon atoms) or aralkyl group (having 7 to 10 carbon atoms)), group represented by —$NHSO_2Ra$ (in which Ra is as defined above), group represented by —SORa (in which Ra is as defined above), group represented by—$SO_2Ra$ (in which Ra is as defined above), group represented by —CORa (in which Ra is as defined above), group represented by

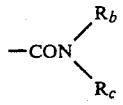

(in which $R_b$ and $R_c$ may be lhe same or different and each represents a hydrogen atom or substituted or unsubstituted alkyl (having 1 to 10 carbon atoms), aryl (having 6 to 10 carbon atoms) or aralkyl (having 7 to 10 carbon atoms) group), group represented by

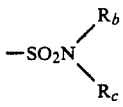

(in which $R_b$ and $R_c$ are as defined above), sulfonic group, amino group, alkoxy group (having 1 to 10 carbon atoms), aryloxy group (having 6 to 10 carbon atoms), alkoxycarbonyl group (having 7 to 10 carbon atoms), acyloxy group (having 1 to 10 carbon atoms), amino or amido group substituted by alkyl (having 1 to 10 carbon atoms), aryl (having 6 to 10 carbon atoms) or aralkyl (having 7 to 10 carbon atoms) group, and trifluoromethyl group. Of these substituents, electron attractive substituents are more preferably used than hydrogen atom.

Specific examples of the compound of the general formula (I) will be set forth below, but the present invention should not be construed as being limited thereto.

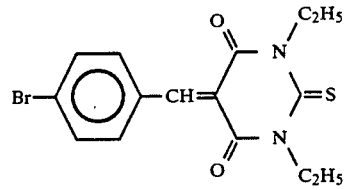

(I)-1

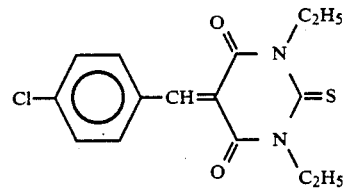

(I)-2

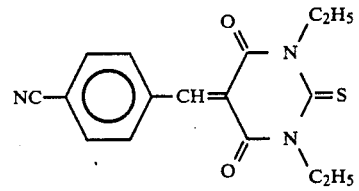

(I)-3

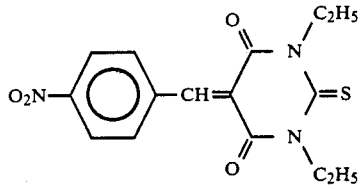

(I)-4

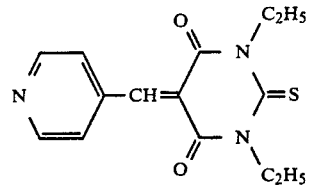

(I)-5

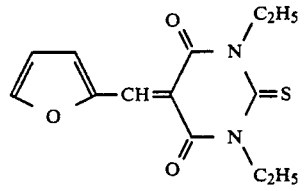

(I)-6

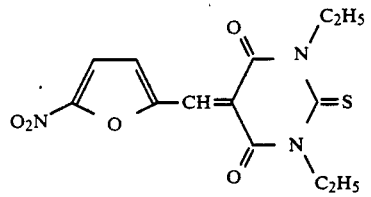

(I)-7

-continued
(I)-8
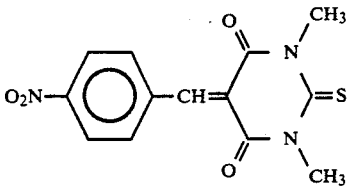
(I)-9
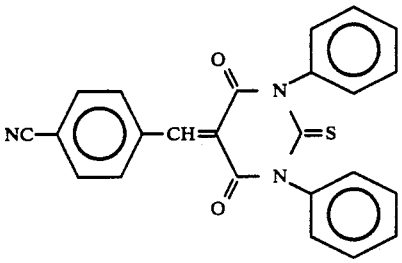
(I)-10
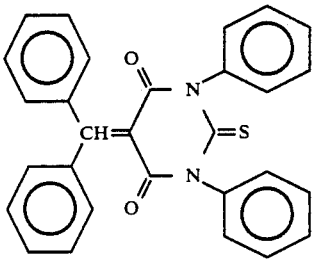
(I)-11
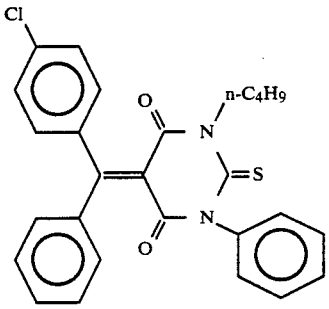
(I)-12
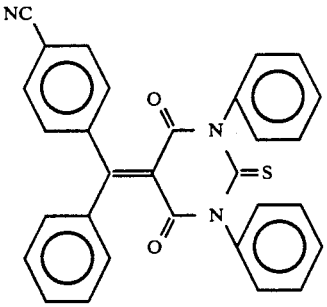
(I)-13
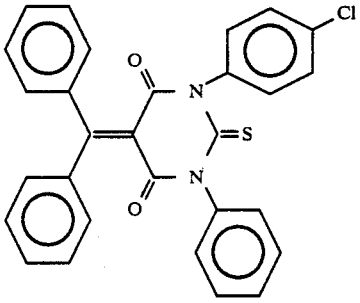
-continued
(I)-14
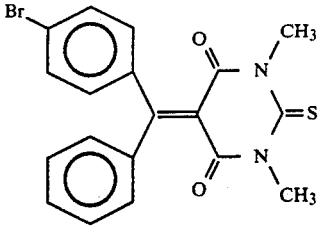
(I)-15
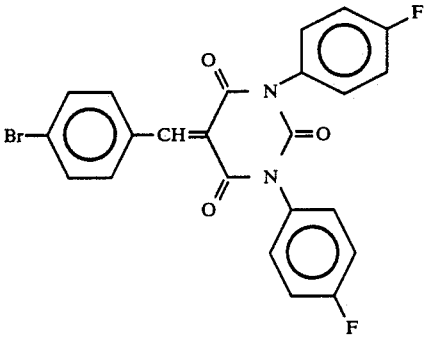
(I)-16
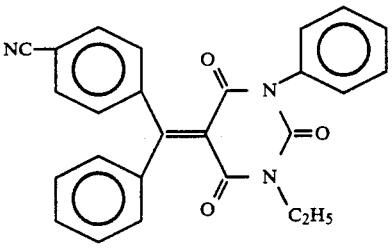
(I)-17
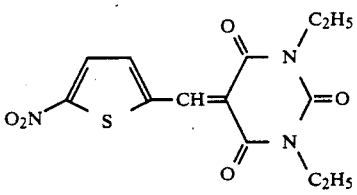
(I)-18
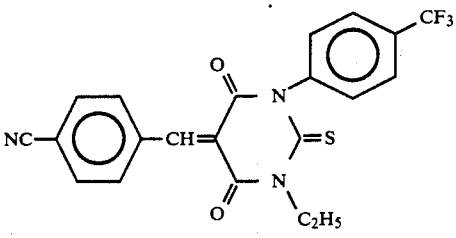
(I)-19
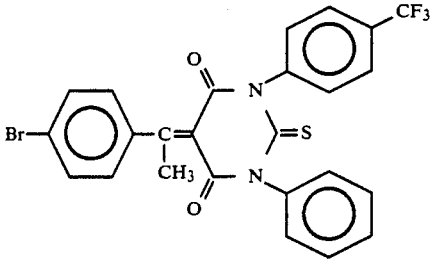

-continued (I)-20

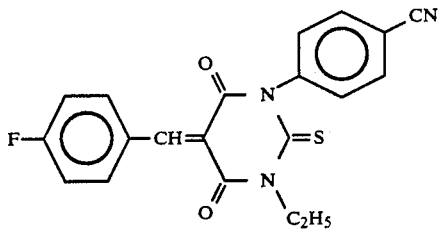

(I)-21

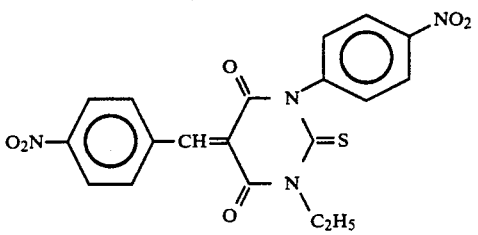

Examples of compounds wherein Ar and $R^3$ together form a ring in the general formula (I) will be set forth below, but the present invention should not be construed as being limited thereto.

(I)-22

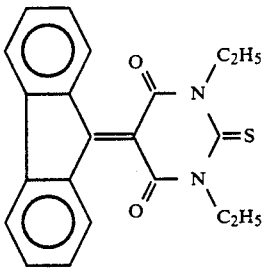

(I)-23

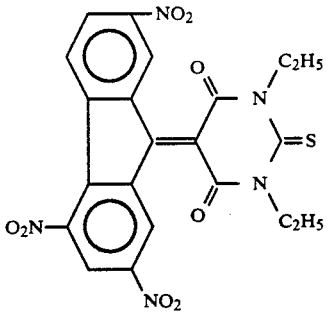

(I)-24

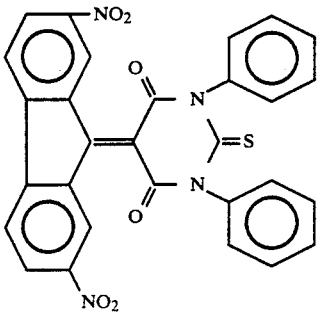

-continued (I)-25

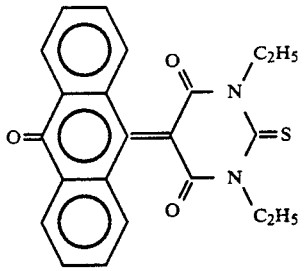

(I)-26

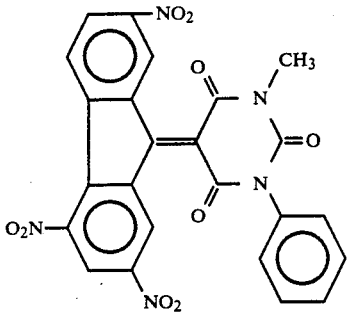

(I)-27

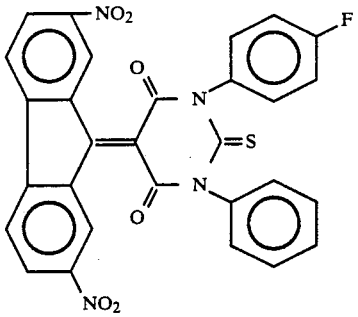

The preparation of these compounds can be easily accomplished by Knoevenagel's condensation process described in "Organic Reactions", Vol. 15, p. 204 to 599, which comprises dehydration condensation of an aldehyde or ketone with barbituric acid or thiobarbituric acid with an alkali (e.g., NaOH, KOH, ammonia, amine such as diethylamine, triethylamine, piperidine) as a catalyst.

The present compound represented by the general formula (II), (III) or (IV) capable of improving the photoconductivity of the photoconductive layer comprising such a phthalocyanine will be further described hereafter.

Z represents a sulfur atom or oxygen atom.

In the general formulae (II), (III), and (IV), if any one of $R^4$ and $R^5$ is an alkyl group, the alkyl group may be a $C_{1-22}$, preferably $C_{1-12}$, more preferably $C_{1-8}$ straight-chain or branched, substituted or unSubstituted alkyl group.

In the general formulae (I), (II) and (III), if any one of $R^4$ to $R^6$ is a substituted aryl group, the substituted alkyl group is a $C_{1-22}$, preferably $C_{1-12}$, more preferably $C_{1-8}$ straight-chain or branched substituted alkyl group to which one to three halogen atoms (e.g., chlorine, bromine, fluorine), cyano groups, nitro groups, phenyl groups or tolyl groups are bonded as a substituent.

If $R^4$ is an alkoxy group or substituted alkoxy group, examples of such an alkoxy group (e.g., methoxy, ethoxy, n-propoxy, iso-propoxy) include an alkoxy group or substituted alkoxy group which includes alkyl group or substituted alkyl group.

If any one of $R^4$, $R^5$ and $R^6$ is a monocyclic or bicyclic condensed aryl group, examples of such an aryl group include, for example, phenyl group, naphthyl group, anthranyl group, biphenyl group, and phenanthryl group.

If any one of $R^4$, $R^5$ and $R^6$ is a substituted monocyclic or bicyclic condensed aryl group, the group can be, for example, phenyl group, naphthyl group, anthranyl group, biphenyl group or phenanthryl group which is substituted with from one to three halogen atoms (for example, chlorine, bromine, fluorine), cyano groups, nitro groups, straight-chain or branched alkyl groups having 1 to 5 carbon atoms, straight-chain or branched alkoxy groups having 1 to 5 carbon atoms, alkoxycarbonyl groups having straight-chain or branched alkyl groups containing 1 to 5 carbon atoms, or acyl groups having straight-chain or branched alkyl groups containing 1 to 5 carbon atoms as a substituent.

If $R^4$ is a substituted or unsubstituted monocyclic or bicyclic condensed aryloxy group, examples of such an aryloxy group (e.g., phenoxy, naphthoxy) include aryloxy group containing the above mentioned substituted or unsubstituted monocyclie or bicyclic condensed aryl group.

If any one of $R^4$, $R^5$ and $R^6$ is a monovalent group derived from a monocyclic or bicyclic condensed ring, examples of such a monovalent group include pyrrolidinyl group, piperidinyl group, piperidino group, morpholinyl group, morpholino group, pyrrolyl group, imidazolyl group, pyridyl group, pyrimidinyl group, indolinyl group, isoindolinyl group, indolyl group, isoindolyl group, benzoimidazolyl group, quinolyl group, and isoquinolyl group.

If $R^4$, $R^5$ and $R^6$ each represents a monovalent group derived from monocyclic or bicyclic condensed ring, they are monovalent groups derived from monocyclic or bicyclic condensed ring heterocyclic rings which are substituted with from one to three halogen atoms (e.g., chlorine, bromine, fluorine), cyano groups, nitro groups, phenyl groups, tolyl groups, benzyl group, phenetyl groups or straight-chain or branched alkyl group having 1 to 5 carbon atoms as a substituent.

In those cases where $R^4$ and $R^5$ or $R^5$ and $R^6$ are connected to each other to form a divalent group, polymethylene group, oxydipolymethine group or halogenated product thereof can be used as a linkage group. The resulting divalent group may be, for example, trimethylene group, tetramethylene group, pentamethylene group, oxydiethylene group ($—CH_2—CH_2—O—CH_2—CH_2—$), and divalent group obtained by substitution of 1 to 3 hydrogen atoms of these divalent groups by a halogen atom (e.g., chlorine, bromine, fluorine), cyano group, nitro group, phenyl group, tolyl group, benzyl group, phenethyl group or $C_{1-5}$ straight-chain or branched alkyl group. Furthermore, these divalent group portions may be part of aryl ring or heterocyclic ring.

If $R^4$, $R^5$ and $R^6$ each represents a monovalent group derived from alkyl, aryl or heterocyclic ring containing 2 or 3 substituents, any combination of aryloxy group.

If $R^7$ is a polymethylene group, examples of such a polymethylene group include $C_{2-22}$, preferably $C_{2-12}$, more preferably $C_{2-8}$ polymethylene groups If $R^7$ is a branched alkanediyl group, examples of such a branched alkanediyl group include $C_{3-22}$, preferably $C_{3-12}$, more preferably $C_{3-8}$ branched alkanediyl group having one free valence in two carbon atoms at any position. If $R^7$ is an arylene group, examples of such an arylene group include o-phenylene group, m-phenylene gorup, p-phenylene group, and naphthylene group having one free valence in two carbon atoms at any position.

Specific examples of compounds represented by the general formulae (II), (III) and (IV) will be set forth below, but the present invention should not be construed as being limited thereto.

(II)-1

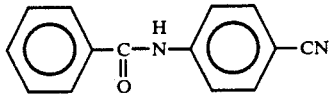

(II)-2

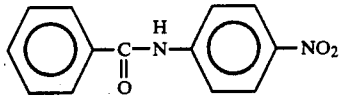

(II)-3

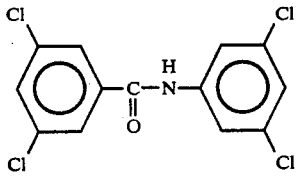

(II)-4

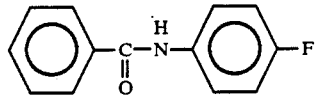

(II)-5

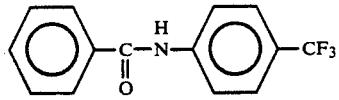

-continued
(II)-6
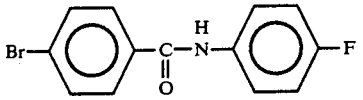
(II)-7
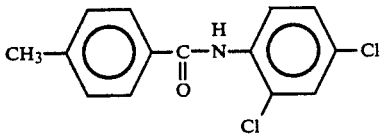
(II)-8
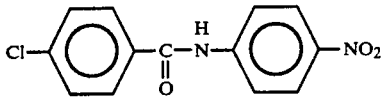
(II)-9
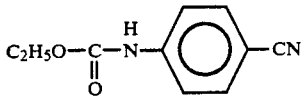
(II)-10
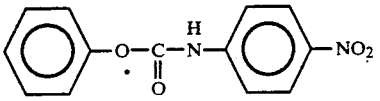
(II)-11
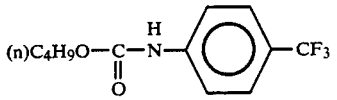
(III)-1
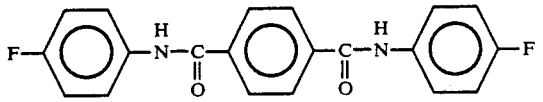
(III)-2
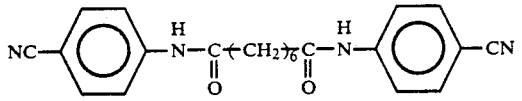
(IV)-1
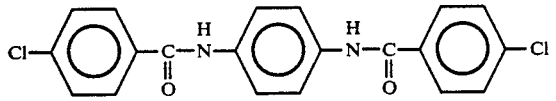
(III)-3
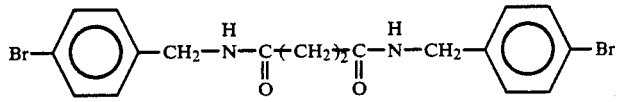
(II)-12
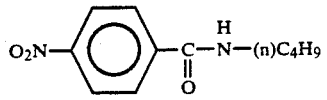
(II)-13
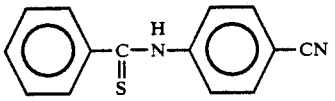
(II)-14
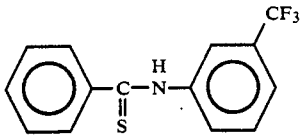

-continued
(II)-15
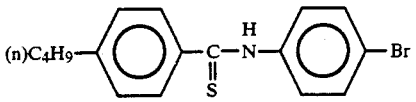
(II)-16
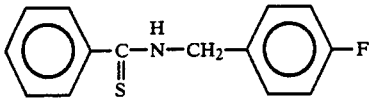
(II)-17
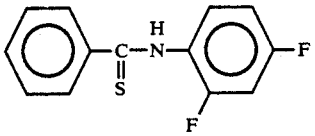
(II)-18
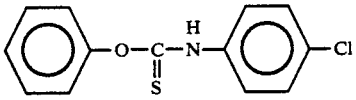
(III)-4
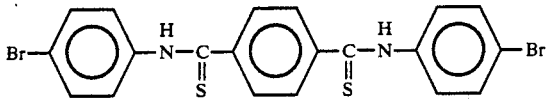
(III)-5
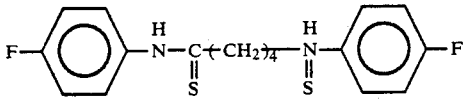
(IV)-2
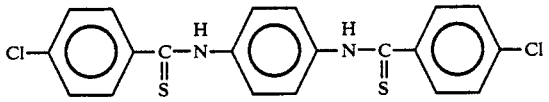
(II)-19
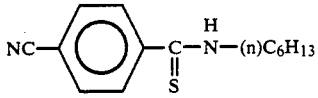
(IV)-3
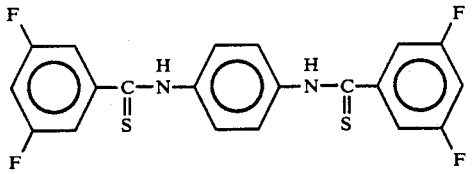
(II)-20
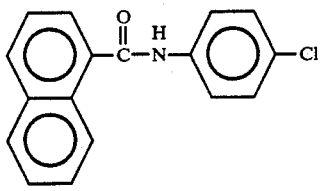
(II)-21
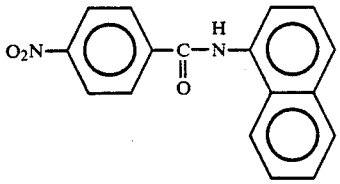

-continued (II)-22

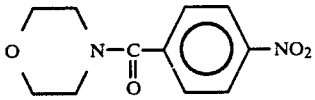

(II)-23

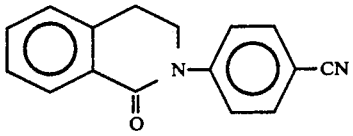

(II)-24

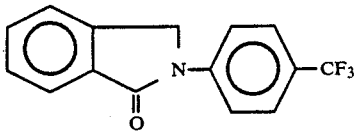

The synthesis of the present urea and thiourea compounds represented by the general formula (II), (III) or (IV) can be easily accomplished by any suitable methods as described in "Beilsteins Handbuchder Organichen Chemie", Vol. 12, p. 262.

The present compound represented by the general formula (V) or (VI) capable of improving the photoconductivity of the photoconductive layer comprising such a phthalocyanine will be further described hereafter.

Z represents a sulfur atom or oxygen atom.

In the general formula (I) or (II), if $R^8$, $R^9$, $R^{10}$, $R^{11}$, $R^{12}$ and $R^{13}$ are an alkyl group, examples of such an alkyl group include $C_{1-22}$ (preferably $C_{1-10}$) straight-chain or branched substituted or unsubstituted alkyl group. Examples of substituents contained in these groups which are substituted include halogen atom (e.g., chlorine, fluorine, bromine), cyano group, nitro group, phenyl group, tolyl group, and trifluoromethyl group. The number of such a substituent to be contained in the substituted alkyl group is 1 to 3.

If any one of $R^8$ to $R^{13}$ is an aryl group (having 6 to 20, preferably 6 to 12 carbon atoms), examples of such an aryl group include substituted or unsubstituted phenyl group, substituted or unsubstituted naphthyl group, and substituted or unsubstituted anthranil group. Examples of the substituents to be contained in these substituted groups include halogen atom (e.g., chlorine, bromine, fluorine), cyano group, nitro group, trifluoromethyl group, $C_{1-5}$ straight-chain or branched alkyl group, carboxyl group, alkoxycarbonyl group, $C_{1-5}$ straight-chain or branched alkyl group substituted by 1 to 3 cyano groups, nitro groups or halogen atoms (e.g., chlorine, bromine, fluorine) (if two or three substituents are contained, they may be the same or different), and $C_{1-5}$ straight-chain or branched alkoxy group substituted by 1 to 3 cyano groups, nitro groups or halogen atoms (e.g., chlorine, bromine, fluorine) (if two or three substituents are contained, they may be the same or different). The number of the substituents to be contained in the substituted group is 1 to 3. If two or three substituents are present, they may be the same or different.

If any one of $R^8$ to $R^{13}$ is a monovalent group derived from a heterocyclic ring, examples of such a monovalent group include pyrrolidinyl group, piperidinyl group, piperidino group, morpholinyl group, morpholino group, pyrrolyl group, imidazolyl group, pyridyl group, pyrimidinyl group, indolinyl group, isoindolinyl group, indolyl group, isoindolyl group, benzoimidazolyl group, quinolyl group, and isoquinolyl group. These groups each may further contain 1 to 3 substituents such as halogen atom (e.g., chlorine, bromine, fluorine), cyano group, nitro group, trifluoromethyl group, phenyl group, tolyl group, benzyl group, phenethyl group and $C_{1-5}$ straight-chain or branched alkyl group (if two or three such substituents are present, they may be the same or different).

If $R^8$ and $R^9$ or $R^{10}$ and $R^{11}$ are connected to each other to form a divalent group, examples of such a divalent group include trimethylene group, tetramethylene group, pentamethylene group, oxydiethylene group ($—CH_2—CH_2—O—CH_2—CH_2—$), and divalent group obtained by substitution of 1 to 3 hydrogen atoms of these divalent groups by a halogen atom (e.g., chlorine, bromine, fluorine), cyano group, nitro group, phenyl group, tolyl group, benzyl group, phenethyl group or $C_{1-5}$ straight-chain or branched alkyl group. Furthermore, these divalent group portions may be part of aryl ring or heterocyclic ring.

If $R^{14}$ is a divalent arylene group, specific examples of such a divalent arylene group include p-phenylene group, m-phenylene group, o-phenylene group, 1,4-naphthylene group, 2,3-naphthylene group, and 4,4'-biphelilylene group. If $R^{14}$ is a polymethylene group, examples of such a polymethylene group include $C_{1-22}$ polymethylene group. If $R^{14}$ is an alkylene group, examples of such an alkylene group include propylene group, butylene group, pentylidene group, 1,2-dimethylethylene group, 1,3-dimethyltrimethylene group, 1,4-dimethyltetramethylene group, 1,5-dimethylpentamethylene group, 1,6-dimethylhexamethylene group, 1-ethylethylene group, and 1,2-diethylethylene group.

If $R^{14}$ is an aralkylene group, examples of such an aralkylene group include

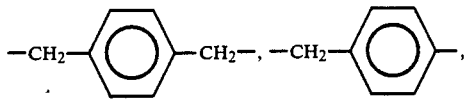

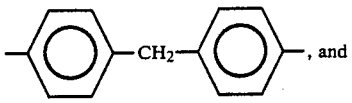

-continued

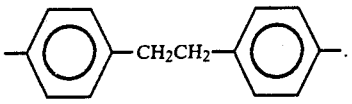

These arylene and aralkylene groups may be substituted by substituents. Examples of such substituents include halogen atom, cyano group, nitro group, trifluoromethyl group, and $C_{1-5}$ alkyl group.

Specific examples of the compounds represented by the general formulae (V) and (VI) include are set forth below, but the present invention should not be construed as being limited thereto.

(V)-1

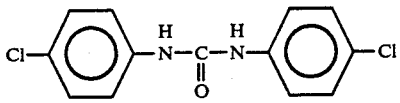

(V)-2

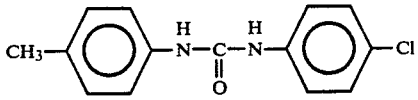

(V)-3

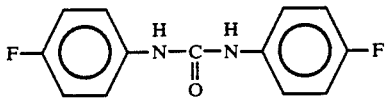

(V)-4

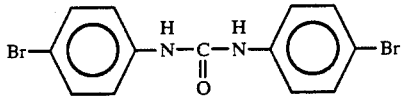

(V)-5

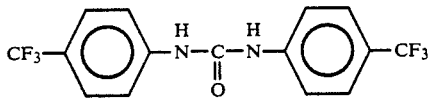

(V)-6

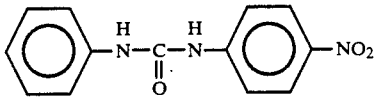

(V)-7

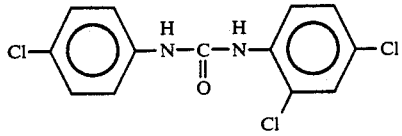

(V)-8

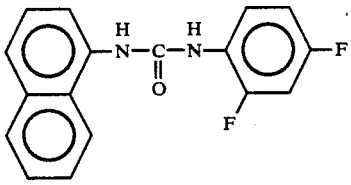

(V)-9

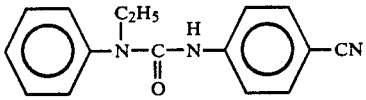

(V)-10

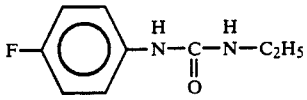

(VI)-1

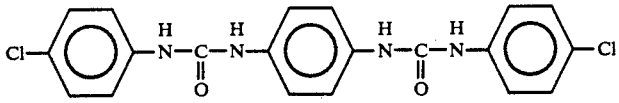

-continued
(VI)-2
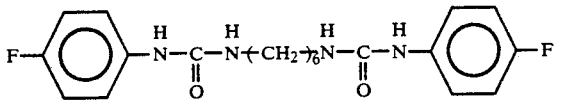
(V)-11
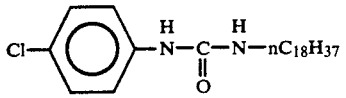
(V)-12
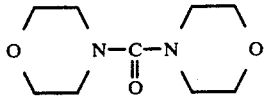
(V)-13
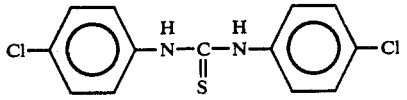
(V)-14
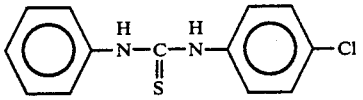
(V)-15
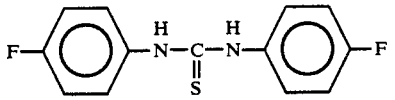
(V)-16
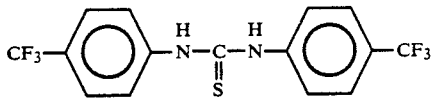
(V)-17
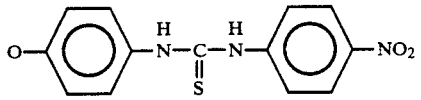
(V)-18
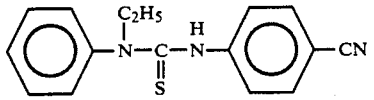
(V)-19
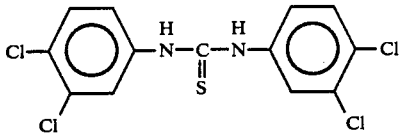
(V)-20
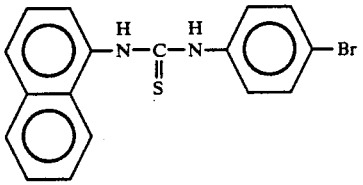
(VI)-3
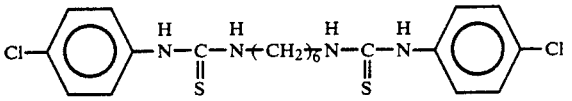
(VI)-4
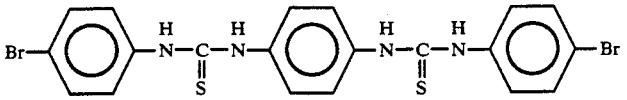

-continued (VI)-5

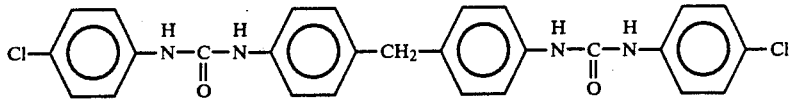

(VI)-6

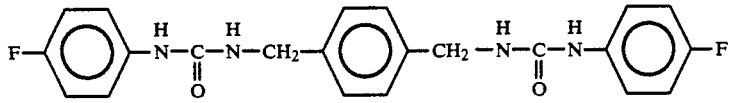

(V)-21

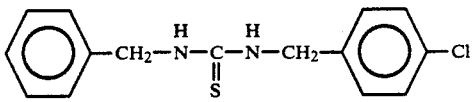

(V)-22

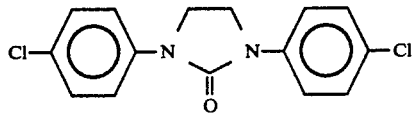

(V)-23

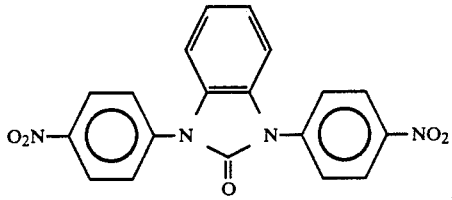

(V)-24

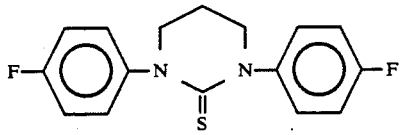

The synthesis of the urea and thiourea compounds represented by the general formulae (V) or (VI) can be easily accomplished with any suitable method as described in *J. Chem. Soc.*, 1955, pp. 1573–1581.

It has been known that an electrophotographic photoreceptor comprising a phthalocyanine pigment exhibits an induction effect of delaying the decay in surface potential shortly after irradiated with light, causing reduction in sensitivity. The mechanism of the phenomenon is not yet made clear. It is believed that the phthalocyanine grains have a carrier trap on the surface thereof by which carriers generated by the irradiation with light are caught, giving a period during which the surface potential shows no decay. The present compound is deemed to be a sensitizer which reduces this induction effect and thus shortens the period during which the surface potential shows no decay (induction period), improving sensitivity.

The use of the present compound represented by the general formula (I) for electrophotographic photoreceptors are described in JP-A-56-149462 and JP-A-57-29050. However, these descriptions are intended for the invention of a chemical sensitizer for a photoconducting polymer and do not refer to an effect of sensitizing a photoconducting pigment. It was therefore not expected at all that the present compound exhibits an effect of reducing an induction effect inherent to a phthalocyanine pigment.

The use of the present compounds represented by the general formulae (II) to (IV) for electrophotographic photoreceptors are described in JP-A-58-102239 and JP-A-58-102240. However, these descriptions are intended for the invention of a sensitizer for a dye-sensitized organic photoconductive material and do not refer to an effect of sensitizing a photoreceptor which has not been dye-sensitized as described herein. Furthermore, these references do not refer to the use of a phthalocyanine pigment as a photoconductive pigment as described herein. It is described in these references that ZnO is used as an inorganic photoconductive pigment. However, it was only known that inorganic photoconductive materials such as ZnO are effective when they are dye-sensitized. It was therefore not expected at all that the present compounds exhibit an effect of reducing an induction effect inherent to a phthalocyanine pigment.

The use of the present compounds represented by the general formulae (V) and (VI) for electrophotographic photoreceptors are described in JP-A-58-65438 and JP-A-58-65439. However, these descriptions are intended for the invention of a sensitizer for a dye-sensitized organic photoconductive material and do not refer to an effect of sensitizing a photoreceptor which has not been dye-sensitized as described herein. Furthermore, these references do not refer to the use of a phthalocyanine pigment as a photoconductive pigment as described herein. It is described in these references that ZnO is used as an inorganic photoconductive pigment. However, it was only known that inorganic photoconductive materials such as ZnO are effective when they are dye-sensitized. It was therefore not expected at all that the present compounds exhibit an effect of reducing an induction effect inherent to a phthalocyanine pigment.

Electrophotographic photoreceptors described in JP-A-56-149462, JP-A-57-29050, JP-A-58-65438, and JP-A-58-65439 exhibit excellent electrophotographic properties so far as they are used only once. However, these electrophotographic photoreceptors exhibit a drastic drop in charged potential and sensitivity and drastic rise in residual potential after repeated use over several time s. The refore, th ese electrophotographic photoreceptors cannot absolutely used as photoreceptors for copying machine and photoprinter which are subject to repeated use.

If these electrophotographic photoreceptors comprise various additives such as electron attractive compound (e.g., tetranitrofluorene, tetracyanoethylene), they exhibit a drop in chargeability and exhibit a drop in charged potential and a rise in residual potential after repeated use.

However, the present compounds represented by the general formulae (I), (II), (III), (IV), (V) and (VI) are capable of sensitizing phthalocyanine without causing such deterioration after repeated use and are suited for the use in copying machine and photoprinter which require photoreceptors having a high sensitivity and an excellent repeatability.

The present electrophotographic photoreceptor comprises a photoconductive layer containing the above-mentioned phthalocyanine pigment and a compound represented by the general formula (I), (II), (III), (IV), (V) or (VI). Electrophotographic photoreceptors have been known in various forms. The present electrophotographic photoreceptor may be in any of these various known forms. The present electrophotographic photoreceptor is normally used in the following exemplary types of layer structures:

(1) Layer structure comprising on an electrically-conductive support a single photoconductive layer containing a phthalocyanine pigment and a compound represented by the general formula (I), (II), (III), (IV), (V) or (VI);

(2) Layer structure comprising on an electrically-conductive support a charge-generating layer containing a phthalocyanine pigment and a compound represented by the general formula (I), (II), (III), (IV), (V) or (VI) and a charge-transporting medium layer provided thereon;

(3) Layer structure comprising on an electrically-conductive support a charge-transporting medium layer and a charge-generating layer containing a phthalocyanine pigment and a compound represented by the general formula (I), (II), (III), (IV), (V) or (VI) provided thereon The preparation of an electrophotographic photoreceptor of the layer structure type (1) can be accomplished by dispersing a phthalocyanine pigment in a solution of a compound represented by the general formula (I), (II), (III), (IV), (V) or (VI) and a binder, coating the dispersion on an electrically-conductive support, and then drying the material. Alternatively, the coating solution can be prepared by dispersing a phthalocyanine pigment in a binder solution, and then dissolving a compound represented by the general formula (I), (II), (III), (IV), (V) or (VI) in the solution. In the case of an electrophotographic photoreceptor of the layer structure type (1), a charge transporting agent as described later can be incorporated in the photoconductive layer for the purpose of facilitating the migration of charge. Electrophotographic photoreceptor having such a composition are normally used. Such an electrophotographic photoreceptor comprises a photoconductive layer having a thickness of 3 to 50 μm, preferably 5 to 30 μm.

The preparation of an electrophotographic photoreceptor of the layer structure type (2) can be accomplished by dispersing a phthalocyanine pigment and a compound represented by the general formula (I), (II), (III), (IV), (V) or (VI) in a proper solvent optionally with a binder dissolved therein, coating the dispersion on an electrically-conductive support to prepare a charge-generating layer, or dispersing a phthalocyanine pigment in a solvent optionally with a binder dissolved therein, dissolving a compound represented by the general formula (I), (II), (III), (IV), (V) or (VI) in the dispersion, and coating the material on an electrically-conductive support to prepare a charge-generating layer, coating a solution of a charge-transporting compound and a binder thereon, and then drying the material to provide a charge-transporting layer thereon. Such an electrophotographic photoreceptor comprises a charge-generating layer having a thickness of 4 μm or less, preferably 0.1 to 2 μm, and a charge-transporting layer having a thickness of 3 to 50 μm, preferably 5 to 30 μm.

Alternatively, the preparation of the present charge-generating layer can be accomplished by providing a thin layer containing a compound represented by the general formula (I), (II), (III), (IV), (V) or (VI) on an electrically-conductive layer, and then evaporating a charge-generating layer comprising a phthalocyanine pigment thereon, whereby the dispersion of the coating solvent causes the phthalocyanine pigment and the compound of the general formula (I), (II), (III), (IV), (V) or (VI) to be incorporated in the layer or by evaporating a phthalocyanine pigment on an electrically-conductive support, and then coating a solution of a compound represented by the general formula (I), (II), (III), (IV), (V) or (VI) thereon so that the compound is present with the phthalocyanine pigment. The thickness of the phthalocyanine pigment thus evaporated is in the range of 0.001 to 1 μm, preferably 0.01 to 0.5 μm.

The preparation of an electrophotographic photoreceptor of the layer structure type (3) can be accomplished by reversing the order of the lamination of the charge-generating layer and the charge-transporting layer in the layer structure type (2).

Since a phthalocyanine pigment itself is capable of transporting charge as compared to azo pigment, the photoreceptor of the layer structure type (1}has a relatively excellent repeatably but has a lower sensitivity and exhibits a slightly large drop in charged potential and rise in residual potential than that of the layer. structure types (2) and (3) after repeated use.

Therefore, electrophotographic photoreceptors of the layer structure types (2) and (3) are preferably used in the present invention. In these layer structure types, high printing-proof and high durability electrophotographic photoreceptors which exhibit an extremely high sensitivity and shows a small change in charged potential and a low residual potential after repeated use can be obtained.

The phthalocyanine pigment to be incorporated in the photoreceptors of the layer structure types (1), (2) and (3) can be subjected to grinding and dispersion by means of a known dispersion apparatus, e.g., ball mill, sand mill and vibration mill. The phthalocyanine grains are used in a grain diameter of 5 μm or less, preferably 0.1 to 2 μm.

If the amount of a phthalocyanine pigment to be incorporated in an electrophotographic photoreceptor of the layer structure type (1) is too small, the photoreceptor thus prepared exhibits a poor sensitivity. On the contrary, if the value is too large, the photoreceptor thus prepared exhibits a poor chargeability and a low strength in the electrophotographic light-sensitive layer. Thus, the proportion of a phthalocyanine pigment in the electrophotographic light-sensitive layer is in the range of 0.01 to 2 times by weight, preferably 0.05 to 1 time by weight that of a binder.

If a charge-transporting compound is incorporated in the photoreceptor, the proportion of the charge-transporting compound is in the range of 0.1 to 2 times by weight, preferably 0.3 to 1.3 times by weight that of a binder.

The content of a compound represented by the general formula (I), (II), (III), (IV), (V) or (VI) is normally in the range of 0.01 to 1 time by weight, preferably 0.02 to 0.4 tμmes by weight that of a phthalocyanine pigment.

The compound represented by the general formula (I), (II), (III), (IV), (V) or (VI) may be used in combination.

In the case where a diazo compound-containing layer is coated on a support in electrophotographic photoreceptors of the layer structure types (2) and (3) as a charge-generating layer, the amount of a phthalocyanine pigment to be used is preferably in the range of 0.1 to 50 times by weight that of a binder resin. If the value is less than this range, a sufficient sensitivity cannot be obtained. The proportion of a charge-transporting compound in a charge-transporting medium is normally in the range of 0 01 to 10 times by weight, preferably 0.2 to 2 times by weight that of a binder.

In this case, too, the content of a compound represented by the general formula (I), (II), (III), (IV), (V) or (VI) is normally in the range of 0.01 to 1 times by weight, preferably 0.02 to 0.4 times by weight that of a phthalocyanine pigment.

In the photoreceptors of the layer structure types (2) and (3), a charge-transporting compound such as hydrazone compound and oxime compound can be incorporated in a charge-generating layer as described in JP-A-60-196767, JP-A-60-254045 and JP-A-60-262159.

Examples of a charge-transporting material which can be incorporated in a photoreceptor of the layer structure type (1) include a wide range of known charge-transporting materials. Charge-transporting materials can be classified into two types, i.e., compound which transports electrons and compound which transports positive holes.

Examples of compounds which transport electrons include compounds containing electrophilic groups, e.g., 2,4,7-trinitro-9-fluorenone, 2,4,5,7-tetranitro-9-fluorenone, 9-dicyanomethylene-2,4,7-trinitrofluorenone, 9-dicyanomethylene-2,4,5,7-tetranitrofluorenone, tetranitrocarbazolechloranyl, 2,3-dichloro-5,6-dicyanobenzoquinone, 2,4,7-trinitro-9,10-phenanthrenequinone, tetrachloro phthalic anhydride, tetracyanoethylene, and tetracyanoquinonedimethane.

Examples of compounds which transport positive holes include compounds containing electron-donating groups. Examples of high molecular compounds containing electron-donating groups include:

(1) Pyrivinyl carbazole and derivatives thereof as described in JP-B-34-10966;

(2) Vinyl polymer, e.g., polyvinyl pyrene, polyvinyl anthracene, poly-2-vinyl-(4'-dimethylaminophenyl)-5-phenyloxazole, and poly-3-vinyl-N-ethylcarbazole as described in JP-B-43-18674 and JP-B-43-19192;

(3) Polymer such as copolymer of polyacenaphthylene, polyindene and acenaphthylene with styrene as described in JP-B-43-19193;

(4) Condensed resin, e.g., pyrene-formaldehyde resin, brompyrene-formaldehyde resin, and ethylcarbazoleformaldehyde resin as described in JP-B-56-13940;

(5}Various triphenylmethane polymers as described in JP-A-56-90883 and JP-A-56-161550.

Examples of low molecular compounds containing electron-donating groups include:

(6) Triazole derivatives as described in U.S. Pat. No. 3,112,197;

(7) Oxadiazole derivatives as described in U.S. Pat. No. 3,189,447;

(8) Imidazole derivatives as described in JP-B-37-16096;

(9) Polyaryl alkane derivatives as described in U.S. Pat. Nos. 3,615,402, 3,820,989, and 3,542,544, JP-B-45-555 and JP-B-51-10983, and JP-A-51-93224, JP-A-55-108667, JP-A-55-156953, and JP-A-56-36656;

(10) Pyrazoline derivatives and pyrazolone derivatives as described in U.S. Pat. Nos. 3,180,729 and 4,278,746, and JP-A-55-88064, JP-A-55-88065, JP-A-49-105537, JP-A-55-51086, JP-A-56-80051, JP-A-56-88141, JP-A-57-45545, JP-A-54-112637, and JP-A-55-74546;

(11) Phenylenediamine derivatives as described in U.S. Pat. No. 3,615,404, JP-B-51-10105, JP-B-46-3712, and JP-B-47-28336, and JP-A-54-83435, JP-A-54-110836, and JP-A-54-119925;

(12) Arylamine derivatives as described in U.S. Pat. Nos. 3,567,450, 3,180,703, 3,240,597, 3,658,520, 4,232,103, 4,175,961, and 4,012,376, JP-B-49-35702, and JP-B-39-27577, West German Pat. No. (DAS) 1110518, and JP-A-55-144250, JP-A-56-119132, and JP-A-56-22437;

(13) Amino-substituted chalkone derivatives as described in U.S. Pat. No. 3,526,501;

(14) N,N-bicarbazyl derivatives as described in U.S. Pat. No. 3,542,546;

(15) Oxazole derivatives as described in U.S. Pat. No. 3,257,203;

(16) Styrylanthracene derivatives as described in JP-A-56-46234;

(17) Fluorenone derivatives as described in JP-A-54-110837;

(18) Hydrazone derivatives as described in U.S. Pat. No. 3,717,462, and JP-A-54-59143 (U.S. Pat. No. 4,150,987), JP-A-55-52063, JP-A-55-52064, JP-A-55-46760, JP-A-55-85495, JP-A-57-11350, JP-A-57-148749, and JP-A-57-104144;

(19) Benzidine derivatives as described in U.S. Pat. Nos. 4,047,948, 4,047,949, 4,265,990, 4,265,990, 4,273,846, 4,299,897, and 4,306,008;

(20) Stilbene derivatives as described in JP-A-58-190953, JP-A-59-95540, JP-A-59-97148 and JP-A-59-195658.

In the present invention, the photoconductive substance is not limited to the compounds (1) to (20). Any known photoconductive substance can be used in the present invention.

These photoconductive substances can be optionally used in combination.

Examples of electrically-conductive support materials to be used for the present electrophotographic photoreceptor include plate or drum of metal such as aluminum, copper, zinc and stainless steel, support material obtained by evaporating or dispersion-coating an electrically-conductive material such as aluminum, indium oxide, $SnO_2$ and carbon or providing an electrically-conductive polymer or the like on a sheet or cylindrical substrate of plastic or paper, paper or paper tube treated with an inorganic salt such as calcium chloride or an organic quaternary ammonium salt, and phenol resin drum, Bakelite drum or the like comprising carbon incorporation-molded therein.

As the resin to be incorporated in the charge-generating layer in the electrophotographic photoreceptor of the layer structure types (2) and (3}there can be selected from a wide range of insulating resins. Examples of such a resin include polyester resin, cellulose resin, acrylic resin, polyamide resin, polyvinyl butyral resin, phenoxy resin, polyvinyl formal resin, polycarbonate resin, styrene resin, polybutadiene resin, polyurethane resin, epoxy resin, silicone resin, vinyl chloride resin, and vinyl chloride-vinyl acetate resin.

As the resin to be incorporated in the charge-transporting layer there may be preferably used a hydrophobic electrical insulating film-forming high molecular polymer having a high dielectric constant Examples of such a high molecular polymer include polycarbonate, polyester, methacrylic resin, acrylic acid, polyvinyl chloride, polyvinylidene chloride, polystyrene, polyvinyl acetate, styrene-butadiene copolymer, vinylidene chloride-acrylonitrile copolymer, vinyl chloride-vinyl acetate copolymer, vinyl chloride-vinyl acetate-maleic anhydride copolymer, silicone resin, silicone-alkyd resin, phenol-formaldehyde resin, styrene-alkyd resin, and poly-N-vinylcarbazole. It goes without saying that the present invention should not be construed as being limited thereto.

As the binder to be incorporated in the photoconductive layer in the electrophotographic photoreceptor of the layer structure type (1) there can be properly selected from binders to be incorporated in the above-mentioned charge-generating layer and charge-transporting layer.

These binders can be used singly or in combination.

In the preparation of the present electrophotographic photoreceptor, the binder can be used in combination with an additive such as plasticizer and sensitizer.

Examples of such a plasticizer include biphenyl, biphenyl chloride, o-terphenyl, p-terphenyl, dibutyl phthalate, dimethyl glycol phthalate, dioctyl phthalate, triphenylphosphoric acid, methylnaphthaline, benzophenone, chlorinated paraffin, polypropyrene, polystyrene, dilauryl thiodipropionate, 3,5-dinitrosalicylic acid, dimethyl phthalate, dibutyl phthalate, diisobutyl azipate, dimethyl sebacate, dibutyl sebacate, butyl laurate, methylphthalyl ethyl glycorate, and various fluorohydrocarbons.

In order to improve the surface properties of the electrophotographic photoreceptor, a silicone oil can be incorporated therein.

Examples of the sensitizer to be incorporated in the electrophotographic photoreceptor include chloranil, tetracyanoethylene, methyl violet, rhodamine B, cyanine dye, melocyanine dye, pyrinium dye, thiapyririum dye, and compounds as described in JP-A-58-65439, JP-A-58-102239, JP-A-58-129439, and JP-A-62-71965.

As the coating solvent there can be used alcohols (e.g., methanol, ethanol, isopropanol), ketones (e.g., acetone, methyl ethyl ketone, methyl isobutyl ketone, cyclohexanone), amides (e.g., N,N-dimethylformamide, N,N-dimethylacetamide), esters (e.g., methyl acetate, ethyl acetate, butyl acetate), ethers (e.g., tetrahydrofuran, dioxane, monoglym, diglym), and halogenated hydrocarbons (e.g., methylene chloride, chloroform, methylchloroform, carbon tetrachloride, monochlorobenzene, dichlorobenzene), singly or in combination.

The coating of the coating solution on a support can be accomplished by an ordinary coating process such as spray coating process, roller coating process, spinner coating process, blade coating process, and dip coating process.

In the present invention, an adhesive layer or barrier layer can be optionally provided between the electrically-conductive support and the photoconductive layer. As the material to be incorporated in such an adhesive layer or barrier layer there can be used a high molecular polymer to be used as the above-mentioned binder as well as gelatin, casein, polyvinyl alcohol, ethyl cellulose, carboxy-methyl cellulose, vinylidene chloride and polymer latex as described in JP-A-59-84247, styrenebutadiene polymer latex as described in JP-A-59-114544, or aluminum oxide The thickness of such a layer is preferably in the range of 0.1 to 5 $\mu$m.

In the present invention, an overcoat layer can be optionally provided on the photoconductive layer. This overcoat layer may be a mechanically-matted resin layer or a resin layer containing a matting agent. Examples of such a matting agent include grains of silicon dioxide, glass, alumina, starch, titanium oxide, zinc oxide, and polymer such as polymethyl methacrylate, polystyrene and phenol resin, and matting agents as described in U.S. Pat. Nos. 2,701,245, and 2,992,101. These matting agents can be used in combination.

As the resin to be incorporated in the overcoat layer there can be selected from resins to be incorporated in the photoconductive layer as well as various known resins.

As described above, the present invention provides a high printing-proof and high durability electrophotographic photoreceptor which exhibits a high sensitivity and shows a small change in charged potential and a low residual potential after repeated use.

It goes without saying that the present electrophotographic photoreceptor and electrophotographic copying machine can be applied in the field of light-sensitive materials for printer utilizing laser or cathode ray tube as light source In particular, the present electrophotographic photoreceptor exhibits a high sensitivity up to long wavelength range and thus is suited to laser beam printers utilizing semiconductor laser, He-Ne laser or the like as light source The present invention will be further described in the following examples, but the present invention should not be construed as being limited thereto The amount of each component is represented in parts by weight.

EXAMPLE 1

| | |
|---|---|
| ϵ-type copper phthalocyanine (Liophoton ERPC; Toyo Ink Mfg. Co., Ltd.) | 3.0 |
| Exemplary Compound (I)-1 | 0.3 |

-continued

| | |
|---|---|
| Polyester resin (Vylon 200; Toyobo Co., Ltd.) | 3.0 |
| Hydrazone compound | 3.0 |

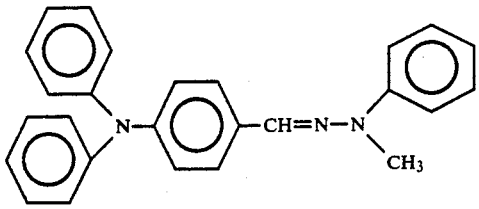

| | |
|---|---|
| Tetrahydrofuran | 100 |

The above-described materials were charged into a 500-ml glass container with glass beads. The materials were then dispersed in a paint shaker (produced by Toyo Seiki Seisakusho K.K.) over 60 minutes. The glass beads were then filtered off to obtain a dispersion for a photoconductive layer.

The dispersion was then coated onto an electrically conductive support having a surface resistance of $10^3\ \Omega$ (prepared by depositing an aluminum film on the surface of a 75-μm thick polyethylene terephthalate film) by means of a wire round rod, and dried to prepare an electrophotographic photoreceptor comprising a 20-μm thick photoconductive layer.

The electrophotographic photoreceptor thus prepared was then measured for electrical properties. Specifically, the electrophotographic photoreceptor was corona-charged at +8.0 kV in a static process by means of EPA-8100 (produced by Kawaguchi Denki K.K.), exposed to monochromatic light with a wavelength of 780 nm and an intensity of 1 mW/m$^2$, and measured for electrical properties. The electrical properties determined were surface potential ($V_0$) shortly after charging, percentage charge retention rate ($DD_{10}$) as ratio of surface potential 10 seconds after charging to $V_{0h}$, exposure ($E_{50}$) such that the surface potential before exposure is attenuated to ½ and exposure ($E_{90}$) such that the surface potential before exposure is attenuated to 1/10, and residual potential ($V_R$) as surface potential upon exposure of 100 μJ/cm$^2$.

The results were as follows:

| | |
|---|---|
| $V_0$ | +660 V |
| $E_{50}$ | 2.2 μJ/cm$^2$ |
| $E_{90}$ | 8.2 μJ/cm$^2$ |
| $DD_{10}$ | 73% |
| $V_R$ | +23 V |

COMPARATIVE EXAMPLE 1

An electrophotographic photoreceptor was prepared in the same manner as in Example 1 except that Exemplary Compound (I)-1 was not incorporated therein. The specimen was then measured for electrical properties in the same manner as in Example 1. The results were as follows:

| | |
|---|---|
| $V_0$ | +670 V |
| $E_{50}$ | 3.8 μJ/cm$^2$ |
| $E_{90}$ | 12.6 μJ/cm$^2$ |
| $DD_{30}$ | 75% |

-continued

| | |
|---|---|
| $V_R$ | +22 V |

EXAMPLE 2

3 parts of e-type copper phthalocyanine (Liphoton ERPC) was dispersed in a ball mill over 20 hours with a solution of 0.3 parts of Exemplary Compound (I)-2 and 3 parts of a polyester resin (Vylon 200) in 100 parts of tetrahydrofuran. The material was then coated on an electrically conductive support (aluminum deposited film as described above), and dried to obtain a 0.5-μm thick charge-generating layer.

A solution obtained by dissolving 9.3 parts of a hydrazone compound of the general formula:

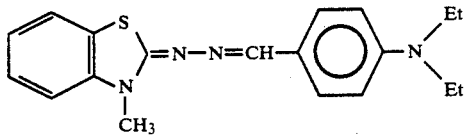

and 10 parts of a polycarbonate of bisphenol A in 50 parts of dichloromethane was then coated onto the charge-generating layer by means of a wire round rod, and dried to form a 20-μm thick charge-transporting layer thereon. Thus, an electrophotographic photoreceptor was prepared. The specimen was then measured for electrical properties in the same manner as in Example 1 except that it was corona-charged at -8 kV.

The results were as follows:

| | |
|---|---|
| $V_0$ | −730 V |
| $E_{50}$ | 1.1 μJ/cm$^2$ |
| $E_{90}$ | 2.9 μJ/cm$^2$ |
| $DD_{10}$ | 78% |
| $V_R$ | 24 V |

Thereafter, the two procedures, i.e., charging and exposure, were repeated 10,000 times. The specimen was then measured for electrical properties. As a result, it was found that the specimen exhibited little or no change in the electrical properties.

COMPARATIVE EXAMPLE 2

An electrophotographic photoreceptor was prepared in the same manner as in Example 2 except that Exemplary Compound (I)-2 was not incorporated therein. The specimen was then measured for electrical properties in the same manner as in Example 2.

The results were as follows:

| | |
|---|---|
| $V_0$ | −738 V |
| $E_{50}$ | 2.0 μJ/cm$^2$ |
| $E_{90}$ | 5.8 μJ/cm$^2$ |
| $DD_{10}$ | 79% |
| $V_R$ | 24 V |

EXAMPLE 3

An electrophotographic photoreceptor was prepared in the same manner as in Example 2 except that X-type metal-free phthalocyanine (Fastogen Blue 8120; Dainippon Ink and Chemicals, Incorporated) was used instead of ε-type copper phthalocyanine (Liphoton ERPC).

The specimen was then measured for electrical properties in the same manner as in Example 2. The results were as follows:

| | |
|---|---|
| $V_0$ | −735 V |
| $E_{50}$ | 0.5 μJ/cm² |
| $E_{90}$ | 1.5 μJ/cm² |
| $DD_{10}$ | 77% |
| $V_R$ | 12 V |

Thereafter, the two procedures, i.e., charging and exposure, were repeated 10,000 times. The specimen was then measured for electrical properties. As a result, it was found that the specimen exhibited little or no change in the electrical properties.

COMPARATIVE EXAMPLE 3

An electrophotographic photoreceptor was prepared in the same manner as in Example 3 except that Exemplary Compound (I)-2 was not incorporated therein. The specimen was then measured for electrical properties in the same manner as in Example 2. The results were as follows:

| | |
|---|---|
| $V_0$ | +740 V |
| $E_{50}$ | 0.9 μJ/cm² |
| $E_{90}$ | 2.7 μJ/cm² |
| $DD_{10}$ | 78% |
| $V_R$ | 15 V |

EXAMPLE 4

An electrophotographic photoreceptor was prepared in the same manner as in Example 2 except that α-type titanyl copper phthalocyanine (produced by Toyo Ink Mg. Co., Ltd.) was used instead of ε-type copper phthalocyanine (Liphoton ERPC). The specimen was then measured for electrical properties in the same manner as in Example 2. The results were as follows:

| | |
|---|---|
| $V_0$ | −710 V |
| $E_{50}$ | 0.35 μJ/cm² |
| $E_{90}$ | 1.0 μJ/cm² |
| $DD_{10}$ | 76% |
| $V_R$ | 13 V |

Thereafter, the two procedures, i.e., charging and exposure, were repeated 10,000 times. The specimen was then measured for electrical properties. As a result, it was found that the specimen exhibited little or no change in the electrical properties.

COMPARATIVE EXAMPLE 4

An electrophotographic photoreceptor was prepared in the same manner as in Example 4 except that Exemplary Compound (I)-2 was not incorporated therein. The specimen was then measured for electrical properties in the same manner as in Example 2. The results were as follows:

| | |
|---|---|
| $V_0$ | −720 V |
| $E_{50}$ | 0.5 μJ/cm² |
| $E_{90}$ | 1.5 μJ/cm² |
| $DD_{10}$ | 77% |
| $V_R$ | 11 V |

EXAMPLES 5 TO 12

Electrophotorgraphic photoreceptors were prepared in the same manner as in Example 2 except that exemplary compounds as set forth in Table 1 were used instead of Exemplary Compound (I)-2. The specimens were then measured for electrical properties in the same manner as in Example 2. The results are set forth in Table 1.

TABLE 1

| | Exemplary Compound | $V_0$ (V) | $E_{50}$ (μJ/cm²) | $E_{90}$ (μJ/cm²) | $DD_{10}$ (%) | $V_R$ (V) |
|---|---|---|---|---|---|---|
| Example 5 | (I)-1 | −720 | 1.0 | 2.7 | 78 | 22 |
| Example 6 | (I)-3 | −708 | 1.2 | 3.0 | 78 | 23 |
| Example 7 | (I)-7 | −712 | 1.3 | 3.2 | 77 | 24 |
| Example 8 | (I)-10 | −706 | 1.1 | 2.9 | 80 | 23 |
| Example 9 | (I)-13 | −705 | 1.3 | 3.2 | 80 | 24 |
| Example 10 | (I)-15 | −730 | 1.2 | 3.0 | 79 | 22 |
| Example 11 | (I)-19 | −703 | 1.1 | 2.8 | 77 | 25 |
| Example 12 | (I)-23 | −719 | 1.2 | 3.1 | 78 | 26 |

EXAMPLE 13

3 parts of X-type metal-free phthalocyanine (Fastogen Blue 8120; Dainippon Ink and Chemicals, Incorporated) was dispersed in a ball mill over 20 hours with a solution of 3 parts of a polyester resin (Vylon 200) in 100 parts of chlorobenzene. 0.3 parts of Exemplary Compound (I)-2 was dissolved in the material The material was then coated on an electrically conductive support by means of a wire round rod, and dried to obtain a 0.5-μm thick charge-generating layer. A charge-transporting layer was then provided on the charge-generating layer in the same manner as in Example 2. Thus, an electrophotographic photoreceptor was prepared. The specimen was then measured for electrical properties in the same manner as in Example 2.

The results were as follows:

| | |
|---|---|
| $V_0$ | −730 V |
| $E_{50}$ | 0.5 μJ/cm² |
| $E_{90}$ | 1.5 μJ/cm² |
| $DD_{10}$ | 78% |
| $V_R$ | 11 V |

Thereafter, the two procedures, i.e., charging and exposure, were repeated 10,000 times. The specimen was then measured for electrical properties. As a result, it was found that the specimen exhibited little or no change in the electrical properties.

The comparison of the results of Examples 1 to 13 and Comparative Examples 1 to 4 shows that the electrophotographic photoreceptors comprising compounds represented by the general formula (I) exhibit a sensitivity 1.5 time to twice that of the comparative specimens. It is also shown that the present specimens exhibit little or no difference in chargeability, potential attenuation in a dark place and charge retention capability and thus exhibit excellent electrical properties. It was further made clear in Examples 2, 3, 4 and 13 that the present specimens exhibited little or no change in the electrical properties after repeated use over 10,000 times

EXAMPLE 14

| | |
|---|---|
| ε-type copper phthalocyanine | 3.0 |

-continued

| | |
|---|---|
| (Liophoton ERPC; Toyo Ink Mfg. Co., Ltd.) | |
| Exemplary Compound (II)-3 | 0.3 |
| Polyester resin | 3.0 |
| (Vylon 200; Toyobo Co., Ltd.) | |
| Hydrazine compound | 3.0 |

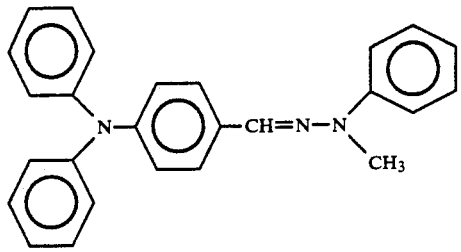

| | |
|---|---|
| Tetrahydrofuran | 100 |

The above-described materials were charged into a 500-ml glass container with glass beads. The materials were then dispersed in a paint shaker (produced by Toyo Seiki Seisakusho K.K.) over 60 minutes. The glass beads were then filtered off to obtain a dispersion for a photoconductive layer.

The dispersion was then coated onto an electrically conductive support having a surface resistance of $10^3\ \Omega$ (prepared by depositing an aluminum film on the surface of a 75-μm thick polyethylene terephthalate film) by means of a wire round rod, and dried to prepare an electrophotographic photoreceptor comprising a 20-μm thick photoconductive layer.

The electrophotographic photoreceptor thus prepared was then measured for electrical properties. Specifically, the electrophotographic photoreceptor was corona-charged at +8.0 kV in a static process by means of EPA-8100 (produced by Kawaguchi Denki K.K.), exposed to monochromatic light with a wavelength of 780 nm and an intensity of 1 mW/m$^2$, and measured for electrical properties. The electrical properties determined were surface potential ($V_0$) shortly after charging, percentage charge retention rate ($DD_{10}$) as ratio of surface potential 10 seconds after charging to $V_0$, exposure ($E_{50}$) such that the surface potential before exposure is attenuated to ½ and exposure ($E_{90}$) such that the surface potential before exposure is attenuated to 1/10, and residual potential ($V_R$) *as surface potential upon exposure of* 100 μJ/cm2.

The results were as follows:

| | |
|---|---|
| $V_0$ | +655 V |
| $E_{50}$ | 2.4 μJ/cm$^2$ |
| $E_{90}$ | 8.9 μJ/cm$^2$ |
| $DD_{10}$ | 74% |
| $V_R$ | +23 V |

COMPARATIVE EXAMPLE 5

An electrophotographic photoreceptor was prepared in the same manner as in Example 14 except that Exemplary Compound (II)-3 was not incorporated therein. The specimen was then measured for electrical properties in the same manner as in Example 14. The results were as follows:

| | |
|---|---|
| $V_0$ | +670 V |
| $E_{50}$ | 3.8 μJ/cm$^2$ |
| $E_{90}$ | 12.6 μJ/cm$^2$ |
| $DD_{30}$ | 75% |
| $V_R$ | +22 V |

EXAMPLE 15

3 parts of ε-type copper phthalocyanine (Liphoton ERPC) was dispersed in a ball mill over 20 hours with a solution of 0.3 parts of Exemplary Compound (II)-3 and 3 parts of a polyester resin (Vylon 200) in 100 parts of tetrahydrofuran. The material was then coated on an electrically conductive support (aluminum deposited film as described above), and dried to obtain a 0.5-μm thick charge-generating layer.

A solution obtained by dissolving 9.3 parts of a hydrazine compound of the general formula:

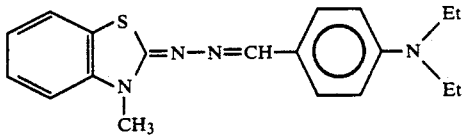

and 10 parts of a polycarbonate of bisphenol A in 50 parts of dichloromethane was then coated onto the charge-generating layer by means of a wire round rod, and dried to form a 20-μm thick charge-transporting layer thereon. Thus, an electrophotographic photoreceptor was prepared. The specimen was then measured for electrical properties in the same manner as in Example 14 except that it was corona-charged at −8 kV.

The results were as follows:

| | |
|---|---|
| $V_0$ | −730 V |
| $E_{50}$ | 1.3 μJ/cm$^2$ |
| $E_{90}$ | 3.1 μJ/cm$^2$ |
| $DD_{10}$ | 78% |
| $V_R$ | 24 V |

Thereafter, the two procedures, i.e., charging and exposure, were repeated 10,000 times. The specimen was then measured for electrical properties. As a result, it was found that the specimen exhibited little or no change in the electrical properties.

COMPARATIVE EXAMPLE 6

An electrophotographic photoreceptor was prepared in the same manner as in Example 15 except that Exemplary Compound (II)-3 was not incorporated therein. The specimen was then measured for electrical properties in the same manner as in Example 15.

The results were as follows:

| | |
|---|---|
| $V_0$ | −738 V |
| $E_{50}$ | 2.0 μJ/cm$^2$ |
| $E_{90}$ | 5.8 μJ/cm$^2$ |
| $DD_{10}$ | 79% |
| $V_R$ | 24 V |

EXAMPLE 16

An electrophotographic photoreceptor was prepared in the same manner as in Example 15 except that X-type metal-free phthalocyanine (Fastogen Blue 8120; Dainippon Ink and Chemicals, Incorporated) was used instead of ε-type copper phthalocyanine (Liphoton ERPC). The specimen was then measured for electrical properties in the same manner as in Example 2. The results were as follows:

| | |
|---|---|
| $V_0$ | −740 V |
| $E_{50}$ | 0.6 μJ/cm² |
| $E_{90}$ | 1.7 μJ/cm² |
| $DD_{10}$ | 77% |
| $V_R$ | 12 V |

Thereafter, the two procedures, i.e., charging and exposure, were repeated 10,000 times The specimen was then measured for electrical properties. As a result, it was found that the specimen exhibited little or no change in the electrical properties.

COMPARATIVE EXAMPLE 7

An electrophotographic photoreceptor was prepared in the same manner as in Example 16 except that Exemplary Compound (II)-3 was not incorporated therein. The specimen was then measured for electrical properties in the same manner as in Example 15. The results were as follows:

| | |
|---|---|
| $V_0$ | −740 V |
| $E_{50}$ | 0.9 μJ/cm² |
| $E_{90}$ | 2.7 μJ/cm² |
| $DD_{10}$ | 78% |
| $V_R$ | 15 V |

EXAMPLE 17

An electrophotographic photoreceptor was prepared in the same manner as in Example 15 except that α-type titanyl copper phthalocyanine (produced by Toyo Ink Mfg. Co., Ltd.) was used instead of ε-type copper phthalocyanine (Liphoton ERPC). The specimen was then measured for electrical properties in the same manner as in Example 15. The results were as follows:

| | |
|---|---|
| $V_0$ | −710 V |
| $E_{50}$ | 0.40 μJ/cm² |
| $E_{90}$ | 1.2 μJ/cm² |
| $DD_{10}$ | 74% |
| $V_R$ | 13 V |

Thereafter, the two procedures, i.e., charging and exposure, were repeated 10,000 times The specimen was then measured for electrical properties. As a result, it was found that the specimen exhibited little or no change in the electrical properties.

COMPARATIVE EXAMPLE 8

An electrophotographic photoreceptor was prepared in the same manner as in Example 16 except that Exemplary Compound (II)-3 to be used in Example 17 was not incorporated therein. The specimen was then measured for electrical properties in the same manner as in Example 15. The results were as follows

| | |
|---|---|
| $V_0$ | −720 V |
| $E_{50}$ | 0.5 μJ/cm² |
| $E_{90}$ | 1.5 μJ/cm² |
| $DD_{10}$ | 77% |
| $V_R$ | 11 V |

EXAMPLES 18 TO 23

Electrophotographic photoreceptors were prepared in the same manner as in Example 15 except that exemplary compounds as set forth in Table 2 were used instead of Exemplary Compound (II)-3. The specimens were then measured for electrical properties in the same manner as in Example 15. The results are set forth in Table 2.

TABLE 2

| Example | Exemplary Compound | $V_0$ (V) | $E_{50}$ (μJ/cm²) | $E_{90}$ (μJ/cm²) | $DD_{10}$ (%) | $V_R$ (V) |
|---|---|---|---|---|---|---|
| 18 | (II)-5 | −710 | 1.2 | 2.9 | 77 | 23 |
| 19 | (II)-8 | −718 | 1.3 | 3.3 | 77 | 25 |
| 20 | (IV)-1 | −720 | 1.4 | 3.5 | 76 | 26 |
| 21 | (II)-14 | −705 | 1.2 | 3.0 | 78 | 24 |
| 22 | (IV)-2 | −700 | 1.5 | 4.0 | 76 | 30 |
| 23 | (II)-21 | −720 | 1.3 | 3.2 | 77 | 23 |

EXAMPLE 24

3 parts of X-type metal-free phthalocyanine (Fastogen Blue; Dainippon Ink and Chemicals, Incorporated) was dispersed in a ball mill over 20 hours with a solution of 3 parts of a polyester resin (Vylon 200) in parts of chlorobenzene. 0.3 parts of Exemplary Compound (II)-3 was dissolved in the material The material was then coated on an electrically conductive support by means of a wire round rod, and dried to obtain a 0.5μm thick charge-generating layer. A charge-transporting layer was then provided on the charge-generating layer in the same manner as in Example 15. Thus, an electrophotographic photoreceptor was prepared. The specimen was then measured for electrical properties in the same manner as in Example 15.

The results were as follows:

| | |
|---|---|
| $V_0$ | −735 V |
| $E_{50}$ | 0.6 μJ/cm² |
| $E_{90}$ | 1.7 μJ/cm² |
| $DD_{10}$ | 77% |
| $V_R$ | 11 V |

Thereafter, the two procedures, i.e., charging and exposure, were repeated 10,000 times. The specimen was then measured for electrical properties. As a result, it was found that the specimen exhibited little or no change in the electrical properties.

The comparison of the results of Examples 14 to 24 and Comparative Examples 5 to 8 shows that the electrophotographic photoreceptors comprising compounds represented by the general formula (II) to (IV) exhibit a sensitivity 1.5 time to twice that of the comparative specimens. It is also shown that the present specimens exhibit little or no difference in chargeability, potential attenuation in a dark place and charge retention capability and thus exhibit excellent electrical properties. It was further made clear in Examples 15, 16, 17 and 24 that the present specimens exhibit little or no change in the electrical properties after repeated use over 10,000 times.

EXAMPLE 25

| | |
|---|---|
| ε-type copper phthalocyanine (Liophoton EPPC; Toyo Ink Mfg. Co., Ltd.) | 3.0 |
| Exemplary Compound (V)-1 | 0.3 |
| Polyester resin | 3.0 |

-continued

| | |
|---|---|
| (Vylon 200; Toyobo Co., Ltd.) | |
| Hydrazine compound | 3.0 |

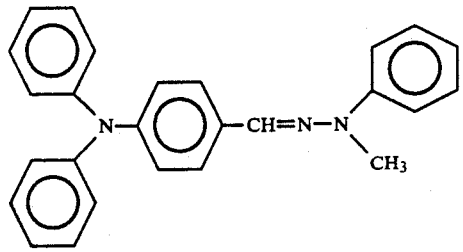

| | |
|---|---|
| Tetrahydrofuran | 100 |

The above-described materials were charged into a 500-ml glass container with glass beads. The materials were then dispersed in a paint shake (produced by Toyo Seiki Seisakusho K.K.) over 60 minutes. The glass beads were then filtered off to obtain a dispersion for a photoconductive layer.

The dispersion was then coated onto an electrically conductive support having a surface resistance of $10^3\ \Omega$ (prepared by depositing an aluminum film on the surface of a 75-μm thick polyethylene terephthalate film) by means of a wire round rod, and dried to prepare an electrophotographic photorecoptor comprising a 20-μm thick photoconducting layer.

The electrophotographic photoreceptor thus prepared was then measured for electrical properties. Specifically, the electrophotographic photoreceptor was corona-charged at +8.0 kV in a static process by means of EPA-8100 (produced by Kawaguchi Denki K.K.), exposed to monochromatic light with a wavelength of 780 nm and an intensity of 1 mW/m$^2$, and measured for electrical properties. The electrical properties determined were surface potential ($V_0$) shortly after charging, percentage charge retention rate ($DD_{10}$) as ratio of surface potential 10 seconds after charging to $V_0$, exposure ($E_{50}$) such that the surface potential before exposure is attenuated to ½ and exposure ($E_{90}$) such that the surface potential before exposure is attenuated to 1/10, and residual potential ($V_R$) as surface potential upon exposure of 100 μJ/cm2.

The results were as follows:

| | |
|---|---|
| $V_0$ | +660 V |
| $E_{50}$ | 2.1 μJ/cm$^2$ |
| $E_{90}$ | 8.0 μJ/cm$^2$ |
| $DD_{10}$ | 72% |
| $V_R$ | +24 V |

COMAPRATIVE EXAMPLE 9

An electrophotographic photoreceptor was prepared in the same manner as in Example 25 except that Exemplary Compound (V)-1 was not incorporated therein. The specimen was then measured for electrical properties in the same manner as in Example 25. The results were as follows:

| | |
|---|---|
| $V_0$ | +670 V |
| $E_{50}$ | 3.8 μJ/cm$^2$ |
| $E_{90}$ | 12.6 μJ/cm$^2$ |
| $DD_{30}$ | 75% |

-continued

| | |
|---|---|
| $V_R$ | +22 V |

EXAMPLE 26

3 parts of ε-type copper phthalocyanine (Liphoton ERPC) was dispersed in a ball mill over 20 hours with a solution of 0.3 parts of Exemplary Compound (V)-1 and 3 parts of a polyester resin (Vylon 200) in 100 parts of tetrahydrofuran. The material was then coated on an electrically conductive support (aluminum deposited film as described above), and dried to obtain a 0.5-μm thick charge-generating layer.

A solution obtained by dissolving 9.3 parts of a hydrazine compound of the general formula:

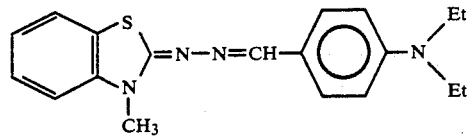

and 10 parts of a polycarbonate of bisphenol A in 50 parts of dichloromethane was then coated onto the charge-generating layer by means of a wire round rod, and dried to form a 20-μm thick charge-transporting layer thereon. Thus, an electrophotographic photoreceptor was prepared. The specimen was then measured for electrical properties in the same manner as in Example 25 except that it was corona-charge at −8 kV.

The results were as follows:

| | |
|---|---|
| $V_0$ | −730 V |
| $E_{50}$ | 1.1 μJ/cm$^2$ |
| $E_{90}$ | 2.8 μJ/cm$^2$ |
| $DD_{10}$ | 76% |
| $V_R$ | 25 V |

Thereafter, the two procedures, i.e., charging and exposure, were repeated 10,000 times. The specimen was then measured for electrical properties. As a result, it was found that the specimen exhibited little or no change in the electrical properties:

COMPARATIVE EXAMPLE 10

An electrophotographic photoreceptor was prepared in the same manner as in Example 26 except that Exemplary Compound (V)-1 was not incorporated therein. The specimen was then measured for electrical properties in the same manner as in Example 26.

The results were as follows:

| | |
|---|---|
| $V_0$ | −738 V |
| $E_{50}$ | 2.0 μJ/cm$^2$ |
| $E_{90}$ | 5.8 μJ/cm$^2$ |
| $DD_{10}$ | 79% |
| $V_R$ | 24 V |

EXAMPLE 27

An electrophotographic photoreceptor was prepared in the same manner as in Example 26 except that X-type metal-free phthalocyanine (Fastogen Blue 8120; Dainippon Ink and Chemicals, Incorporated) was used instead of ε-type copper phthalocyanine (Liphoton ERPC).

The specimen was then measured for electrical properties in the same manner as in Example 26. The results were as follows:

| | |
|---|---|
| $V_0$ | −735 V |
| $E_{50}$ | 0.6 μJ/cm² |
| $E_{90}$ | 1.7 μJ/cm² |
| $DD_{10}$ | 77% |
| $V_R$ | 13 V |

Thereafter, the two procedures, i.e., charging and exposure, were repeated 10,000 times. The specimen was then measured for electrical properties. As a result, it was found that the specimen exhibited little or no change in the electrical properties.

COMPARATIVE EXAMPLE 11

An electrophotographic photoreceptor was prepared in the same manner as in Example 27 except that Exemplary Compound (V)-1 was not incorporated therein. The specimen was then measured for electrical properties in the same manner as in Example 26. The results were as follows:

| | |
|---|---|
| $V_0$ | +740 V |
| $E_{50}$ | 0.9 μJ/cm² |
| $E_{90}$ | 2.7 μJ/cm² |
| $DD_{10}$ | 78% |
| $V_R$ | 15 V |

EXAMPLE 28

An electrophotographic photoreceptor was prepared in the same manner as in Example 26 except that α-type titanyl copper phthalocyanine (produced by Toyo Ink Mfg. Co., Ltd.) was used instead of ε-type copper phthalocyanine (Liphoton ERPC). The specimen was then measured for electrical properties in the same manner as in Example 26. The results were as follows:

| | |
|---|---|
| $V_0$ | −710 V |
| $E_{50}$ | 0.37 μJ/cm² |
| $E_{90}$ | 1.1 μJ/cm² |
| $DD_{10}$ | 75% |
| $V_R$ | 12 V |

Thereafter, the two procedures, i.e., charging and exposure, were repeated 10,000 times. The specimen was then measured for electricla properties. As a result, it was found that the specimen exhibited little or no change in the electrical properties.

COMPARATIVE EXAMPLE 12

An electrophotographic photoreceptor was prepared in the same manner as in Example 27 except that Exemplary Compound (V)-1 to be used in Example 28 was not incorporated therein. The specimen was then measured for electrical properties in the same manner as in Example 26. The results were as follows:

| | |
|---|---|
| $V_0$ | −720 V |
| $E_{50}$ | 0.5 μJ/cm² |
| $E_{90}$ | 1.5 μJ/cm² |
| $DD_{10}$ | 77% |
| $V_R$ | 11 V |

EXAMPLES 29 TO 34

Electrophotographic photoreceptors were prepared in the same manner as in Example 26 except that exemplary compounds as set forth in Table 3 were used instead of Exemplary Compound (V)-1. The specimens were then measured for electrical properties in the same manner as in Example 26. The results are set forth in Table 3.

TABLE 3

| Example | Exemplary Compound | $V_0$ (V) | $E_{50}$ (μJ/cm²) | $E_{90}$ (μJ/cm²) | $DD_{10}$ (%) | $V_R$ (V) |
|---|---|---|---|---|---|---|
| 29 | (V)-5 | −710 | 1.0 | 2.6 | 75 | 23 |
| 30 | (V)-6 | −708 | 1.1 | 2.7 | 76 | 25 |
| 31 | (VI)-1 | −698 | 1.0 | 2.6 | 74 | 24 |
| 32 | (V)-13 | −732 | 1.2 | 2.9 | 76 | 26 |
| 33 | (V)-16 | −725 | 1.3 | 3.2 | 77 | 28 |
| 34 | (VI)-5 | −700 | 1.1 | 2.9 | 75 | 25 |

EXAMPLE 25

3 parts of X-type metal-free phthalocyanine (Fastogen Blue 8120); Dainippon Ink and Chemicals, Incorporated) was dispersed in a ball mill over 20 hours with a solution of 3 parts of a polyester resin (Vylon 200) in 100 parts of chlorobenzene. 0.3 parts of Exemplary Compound (V)-1 was dissolved in the material. The material was then coated on an electrically conductive support by means of a wire round rod, and dried to obtain a 0.5μm thick charge-generating layer. A charge-transporting layer was then provided on the charge-generating layer in the same manner as in Example 26. Thus, an electrophotographic photoreceptor was prepared. The specimen was then measured for electrical properties in the same manner as in Example 26.

The results were as follows:

| | |
|---|---|
| $V_0$ | −730 V |
| $E_{50}$ | 0.6 μJ/cm² |
| $E_{90}$ | 1.7 μJ/cm² |
| $DD_{10}$ | 76% |
| $V_R$ | 12 V |

Thereafter, the two procedures, i.e., charging and exposure, were repeated 10,000 times. The specimen was then measured for electrical properties. As a result, it was found that the specimen exhibited little or no change in the electrical properties.

The comparison of the results of Examples 25 to 35 and Comparative Examples 9 to 12 shows that the electrophotographic photoreceptors comprising compounds represented by the general formula (V) or (VI) exhibit a sensitivity 1.5 time to twice that of the comparative specimens. It is also knonw that the present specimens exhibit little or no difference in chargeability, potential attenuation in a dark place and charge retention capability and thus exhibit excellent electrical properties. It was further made clear in Examples 26, 27, 28 and 35 that the present specimens exhibited little or no change in the electrical properties after repeated use over 10,000 times.

Thus, it was made clear that the objects of the present invention can be accomplished with the electrophotographic photoreceptors shown in these examples. Specifically, an electrophotographic pohotoreceptor which exhibits a high sensitivity and an excellent durability after repeated use, such as high potential stability and small residual potential can be provided.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor for copying machine or photoprinter comprising an electrically conductive support having thereon a photoconductive layer, wherein said photoconductive layer contains a phthalocyanine pigment and a compound represented by the general formula (I), (II), (III), (IV) or (VI):

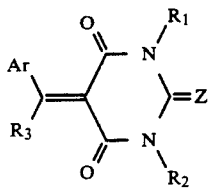

(I)

wherein z represents a sulfur or oxygen atom;

Ar represents a monovalent aromatic hydrocarbon group or monovalent heterocyclic group;

$R_3$ represents a hydrogen atom, alkyl group, aryl group or aralkyl group;

Ar and $R_3$ may together form a ring; and $R_1$ and $R_2$ may be the same or different and each represents an alkyl group, aryl group or aralkyl group;

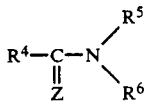

(II)

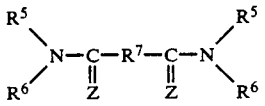

(III)

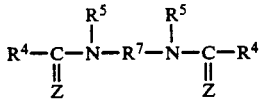

(IV)

wherein Z represents a sulfur or oxygen atom;

$R_4$ represents an alkyl group, akloxy group, monovalent or bicyclic condensed aryl group, monocyclic or bicyclic condensed aryloxy group or monovalent group derived from heterocyclic group, the two R's in the general formula (IV) being the same or different;

$R^5$ and $R^6$ may be the same or different and each represents a hydrogen atom, alkyl group, monocyclic or bicyclic condensed aryl group or monovalent group derived from heterocyclic group;

$R^7$ represents a methylene group, polymethylene group, branched alkanediyl group or arylene group; and $R^4$ and $R^5$ or $R^5$ and $R^6$ may be connected to each other:

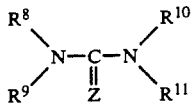

(V)

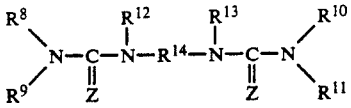

(VI)

wherein Z represents a sulfur or oxygen atom;

$R^8$, $R^9$, $R^{10}$, $R^{11}$, $R^{12}$ and $R^{13}$ may be the same or different and each represents a hydrogen atom, an alkyl group, aryl group or monovalent group derived from heterocyclic gruop, $R^8$ and $R^9$ or $R^{10}$ and $R^{11}$ being optionally connected to each other;

$R^8$, $R^9$, $R^{10}$ and $R^{11}$ in the general formula (V) being optionally connected to each other to form a cross-linked ring; and $R^{14}$ represents a divalent arylene group, aralkylene group, polymethylene group or alkylene group; and wherein the content of the compound represented by general formula (I), (II), (III), (IV), (V) or (VI) is in the range of 0.01 to 1.0 times by weight of the phthalocyanine pigment.

2. An electrophotographic receptor for copying machine or photoprinter according to claim 1, wherein said photoconductive layer is a single layer containing a phthalocyanine pigment and a compound represented by the general formula (I), (II), (III), (IV), (V) or (VI)

3. An electrophotographic photoreceptor for copying machine or photoprinter according to claim 1, generating layer containing a phthalocyanine pigment and a compound represented by the general formula (I), (II), (III), (IV), (V) or (VI) and a charge-transporting layer.

4. An electrophotographic photoreceptor for copying machine or photoprinter according to claim 1 wherein the light source of said copying machine or photoprinter is a laser.

5. An electrophotographic photoreceptor for copying machine or photoprinter comprising an electrically conductive support having thereon a photoconductive layer; wherein said photoconductive layer contains a phthalocyanine pigment and a compound represented by the general formula (I), (II), (III), (IV) or (VI):

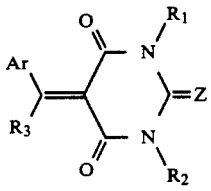

(I)

wherein

Z represents a sulfur or oxygen atom;

Ar represents a monovalent aromatic hydrocarbon group or monovalent heterocyclic group;

$R_3$ represents a hydrogen atom, alkyl group, aryl group or aralkyl group;

Ar and $R_3$ may together form a ring; and $R_1$ and $R_2$ may be the same or different and each represents an alkyl group, aryl group or aralkyl group;

(II)

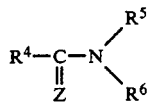

(III)

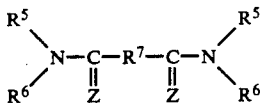

(IV)

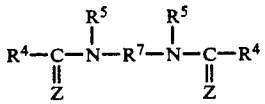

wherein Z represents a sulfur or oxygen atom;

$R_4$ represents an alkyl group, akloxy group, monovalent or bicyclic condensed aryl group, monocyclic or bicyclic condensed aryloxy group or monovalent group derived from heterocyclic group, the two R's in the general formula (IV) being the same or different;

$R^5$ and $R^6$ may be the same or different and each represents a hydrogen atom, alkyl group, monocyclic or bicyclic condensed aryl group or monovalent group derived from heterocyclic group;

$R^7$ represents a methylene group, polymethylene group, branched alkanediyl group or arylene group; and $R^4$ and $R^5$ or $R^5$ and $R^6$ may be connected to each other:

(V)

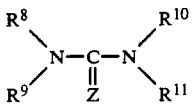

(VI)

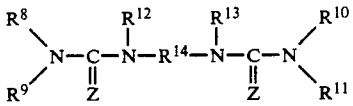

wherein Z represents a sulfur or oxygen atom;

$R^8$, $R^9$, $R^{10}$, $R^{11}$, $R^{12}$ and $R^{13}$ may be the same or different and each represents a hydrogen atom, an alkyl group, aryl group or monovalent group derived from heterocyclic gruop, $R^8$ and $R^9$ or $R^{10}$ and $R^{11}$ being optionally connected to each other;

$R^8$, $R^9$, $R^{10}$ and $R^{11}$ in the general formula (V) being optionally connected to each other to form a cross-linked ring; and $R^{14}$ represents a divalent arylene group, aralkylene group, polymethylene group or alkylene group; and wherein the photoreceptor is of the layer structure type comprising a single photoconductive layer, the content of the compound represented by general formula (I), (II), (III), (IV), (V) or (VI) is in the range of 0.01 to 1 times by weight that of the phthalocyanine pigment, and the proportino of the phthalocyanine pigment in the electrophotographic light-sensitive layer is in the range of 0.01 to 2.0 times by weight that of the binder.

6. An An electrophotographic photoreceptor for copying machine or photoprinter comprising an electrically conductive support having thereon a photoconductive layer, wherein said photoconductive layer contains a phthalocyanine pigment and a compound represented by the general formula (I), (II), (III), (IV) or (V):

(I)

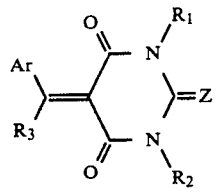

wherein

Z represents a sulfur or oxygen atom;

Ar represents a monovalent aromatic hydrocarbon group or monovalent heterocyclic group;

$R_3$ represents a hydrogen atom, alkyl group, aryl group or aralkyl group;

Ar and $R_3$ may together form a ring; and $R_1$ and $R_2$ may be the same or different and each represents an alkyl group, aryl group or aralkyl group;

(II)

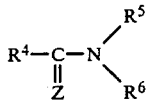

(III)

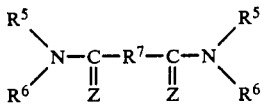

(IV)

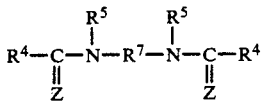

wherein Z represents a sulfur or oxygen atom;

$R_4$ represents an alkyl group, akloxy group, monovalent or bicyclic condensed aryl group, monocyclic or bicyclic condensed aryloxy group or monovalent group derived from heterocyclic group, the two R's in the general formula (IV) being the same or different;

$R^5$ and $R^6$ may be the same or different and each represents a hydrogen atom, alkyl group, monocyclic or bicyclic condensed aryl group or monovalent group derived from heterocyclic group;

$R^7$ represents a methylene group, polymethylene group, branched alkanediyl group or arylene group; and $R^4$ and $R^5$ or $R^5$ and $R^6$ may be connected to each other:

(V)

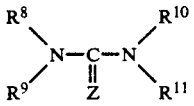

(VI)

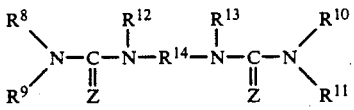

wherein Z represents a sulfur or oxygen atom;

$R^8$, $R^9$, $R^{10}$, $R^{11}$, $R^{12}$ and $R^{13}$ may be the same or different and each represents a hydrogen atom, an alkyl group, aryl group or monovalent group derived from heterocyclic gruop, $R^8$ and $R^9$ or $R^{10}$ and $R^{11}$ being optionally connected to each other;

$R^8$, $R^9$, $R^{10}$ and $R^{11}$ in the general formula (V) being optionally connected to each other to form a cross-linked ring; and $R^{14}$ represents a divalent arylene group, aralkylene group, polymethylene group or alkylene group; and wherein the photoreceptor is of the type comprising separate charge generating and charge transporting layers, the content of the compound represented by general formula (I), (II), (III), (IV), (V) or (VI) is in the range of 0.01 to 1.0 times by weight that of the phthalocyanine pigment, and the amount of phthalocyanine pigment is in the range of 0.01 to 50.0 times that of the binder resin.

* * * * *